US005824922A

United States Patent [19]

Aonuma et al.

[11] Patent Number: 5,824,922

[45] Date of Patent: Oct. 20, 1998

[54] WEAR-RESISTANT SINTERED ALLOY, AND ITS PRODUCTION METHOD

[75] Inventors: Koichi Aonuma; Yoshimasa Aoki; Koichiro Hayashi, all of Matsudo, Japan

[73] Assignee: Hitachi Powdered Metals Co., Ltd., Matsudo, Japan

[21] Appl. No.: 779,517

[22] Filed: Jan. 7, 1997

[30] Foreign Application Priority Data

Jan. 19, 1996 [JP] Japan ..... 8-024888

[51] Int. Cl.[6] ..... C22C 29/02

[52] U.S. Cl. ..... 75/236; 75/231; 75/246; 419/10; 419/27

[58] Field of Search ..... 75/231, 243, 246, 75/236; 419/10, 27

[56] References Cited

U.S. PATENT DOCUMENTS

| | | | |
|---|---|---|---|
| 4,388,114 | 6/1983 | Suganuma et al. | 75/243 |
| 4,526,617 | 7/1985 | Hiraoka et al. | 75/236 |
| 4,724,000 | 2/1988 | Larson et al. | 75/236 |
| 4,909,843 | 3/1990 | Leithner | 75/237 |
| 5,049,183 | 9/1991 | Saka et al. | 75/244 |
| 5,462,573 | 10/1995 | Baker et al. | 75/231 |
| 5,529,602 | 6/1996 | Ishii et al. | 75/231 |

FOREIGN PATENT DOCUMENTS

| | | |
|---|---|---|
| 40 31 408 | 4/1991 | Germany . |
| 55-36242 | 9/1980 | Japan . |
| 62-10244 | 1/1987 | Japan . |
| 2-111848 | 4/1990 | Japan . |
| 7-233454 | 9/1995 | Japan . |

*Primary Examiner*—Ngoclan Mai
*Attorney, Agent, or Firm*—Evenson, McKeown, Edwards & Lenahan, P.L.L.C.

[57] ABSTRACT

The invention provides a valve seat having a suitable degree of wear resistance, which can be produced without recourse to expensive elements represented by cobalt and at a cost lower than ever before. This valve seat is formed of a wear-resistant sintered alloy having a general composition consisting essentially of, in weight ratio, 0.736 to 9.65% of nickel, 0.736 to 2.895% of copper, 0.294 to 0.965% of molybdenum, 0.12 to 6.25% of chromium, and 0.508 to 2.0% of carbon with the balance being iron, and inevitable impurities, and having a metallic structure in which there are dispersed (1) a martensite, (2) a bainite having a nucleus of sorbite and/or upper bainite and surrounding said nucleus, (3) an austenite having a high nickel concentration, and (4) a hard phase surrounding with a ferrite having a high chromium concentration and composed mainly of a chromium carbide.

18 Claims, 10 Drawing Sheets

WEAR-RESISTANT SINTERED ALLOY, AND ITS PRODUCTION METHOD

BACKGROUND OF THE INVENTION

The present invention relates to a wear-resistant sintered alloy best suited for valve seats in internal combustion engines in particular.

To accommodate to high-performance, and high-output engines for automobiles, sintered alloys for valve seats are now required to have wear resistance and strength at high temperatures. The applicant of the present application, too, have developed a valve seat sintered alloy (Japanese Patent Publication No. 36242/1980) produced by the production method registered under Patent No. 1043124. Furthermore in Japanese Patent Laid-Open No. 10244/1987, Japanese Patent Laid-Open No. 233454/1995 and so on, applicants have put forward sintered alloys much more improved in terms of wear resistance and strength at high temperatures so as to meet recent demands toward much more enhanced performance and output, especially elevated combustion temperatures at low air fuel ratios. However, these materials cost much because large amounts of expensive elements such as cobalt are incorporated in a matrix component to make improvements in performance at high temperatures.

Recently developed, more sophisticated engine design technology, however, enables materials other than high-performance yet costly materials such as those set forth in the aforesaid Japanese Patent Laid-Open No. 10244/1987 and Japanese Patent Laid-Open No. 233454/1995 to be utilized for valve seats. In particular, valve seats located on an intake side are lower than those located on an exhaust side in terms of the environmental temperature at which they are used, and so the use of materials such as those described in the aforesaid Japanese Patent Laid-Open No. 10244/1987 and Japanese Patent Laid-Open No. 233454/1995 for such valve seats become unreasonable in view of quality. On the other hand, recent trends in the development of automobiles are shifting from automobiles designed for much importance to performance to those designed for much weight to high cost-performance or economical considerations. Thus, inexpensive sintered alloys having a moderate degree of wear resistance, rather than those having excessive wear resistance, are now required for future valve seat sintered alloys.

It is therefore an object of the present invention to meet the aforesaid requirement by providing a valve seat or other like part having a reasonable degree of wear resistance without recourse to any costly element such as cobalt and, hence, at a cost lower than ever before.

SUMMARY OF THE INVENTION

To achieve the aforesaid object, according to a first aspect of the present invention there is provided a wear-resistant sintered alloy having a general composition consisting essentially of, in weight ratio, 0.736 to 9.65% of nickel, 0.736 to 2.895% of copper, 0.294 to 0.965% of molybdenum, 0.12 to 6.25% of chromium, and 0.508 to 2.0% of carbon with the balance being iron, and inevitable impurities, and having a micro structure in which there are dispersed (1) a martensite, (2) a bainite having a nucleus of sorbite and/or upper bainite and surrounding said nucleus, (3) an austenite having a high nickel concentration, and (4) a hard phase surrounding with a ferrite having a high chromium concentration and composed mainly of a chromium carbide.

According to a second aspect of the present invention, there is provided a wear-resistant sintered alloy having a general composition consisting essentially of, in weight ratio, 0.736 to 9.65% of nickel, 0.736 to 2.895% of copper, 0.303 to 1.715% of molybdenum, 0.12 to 6.25% of chromium, and 0.508 to 2.0% of carbon with the balance being iron, and inevitable impurities, and having a micro structure in which there are dispersed (1) a martensite, (2) a bainite having a nucleus of sorbite and/or upper bainite and surrounding said nucleus, (3) an austenite having a high nickel concentration, and (4) a hard phase surrounding with a ferrite having a high chromium concentration and composed mainly of a chromium carbide.

According to a third aspect of the present invention, there is provided a wear-resistant sintered alloy having a general composition consisting essentially of, in weight ratio, 0.736 to 9.65% of nickel, 0.736 to 2.895% of copper, 0.303 to 1.715% of molybdenum, 0.12 to 6.25% of chromium, 0.508 to 2.0% of carbon, and 0.006 to 0.55% of vanadium and/or 0.03 to 1.25% of tungsten with the balance being iron, and inevitable impurities, and having a micro structure in which there are dispersed (1) a martensite, (2) a bainite having a nucleus of sorbite and/or upper bainite and surrounding said nucleus, (3) an austenite having a high nickel concentration, and (4) a hard phase surrounding with a ferrite having a high chromium concentration and composed mainly of a chromium carbide.

According to a fourth aspect of the present invention, there is provided a wear-resistant sintered alloy wherein 2.0% or less by weight of manganese sulfide is homogeneously dispersed in the wear-resistant sintered alloy according to any one of the aforesaid first to third aspects of the present invention.

According to a fifth aspect of the present invention, there is provided a sintered alloy wherein any one of an acrylic resin, lead or a lead alloy, and copper or a copper alloy is dispersed into pores in the wear-resistant sintered alloy according to any one of the first to fourth aspects of the present invention.

The present invention provides a method of producing the wear-resistant sintered alloy according to the aforesaid first aspect wherein a powder mixture of 0.5 to 1.4% by weight of a graphite powder and 3 to 25% by weight of a hard phase-forming powder having a composition consisting essentially of, in weight ratio, 4.0 to 25% of chromium, and 0.25 to 2.4% of carbon with the balance being iron, and inevitable impurities is used with a matrix-forming, partially diffused alloy powder having a composition consisting essentially of, in weight ratio, 1 to 10% of nickel, 1 to 3% of copper, and 0.4 to 1.0% of molybdenum with the balance being iron, and inevitable impurities.

The present invention provides a method of producing the wear-resistant sintered alloy according to the aforesaid second aspect wherein a powder mixture of 0.5 to 1.4% by weight of a graphite powder and 3 to 25% by weight of a hard phase-forming powder having a composition consisting essentially of, in weight ratio, 4.0 to 25% of chromium, 0.3 to 3.0% of molybdenum, and 0.25 to 2.4% of carbon with the balance being iron, and inevitable impurities is used with a matrix-forming, partially diffused alloy powder having a composition consisting essentially of, in weight ratio, 1 to 10% of nickel, 1 to 3% of copper, and 0.4 to 1.0% of molybdenum with the balance being iron, and inevitable impurities.

The present invention provides a method of producing the wear-resistant sintered alloy according to the aforesaid third aspect wherein a powder mixture of 0.5 to 1.4% by weight of a graphite powder and 3 to 25% by weight of a hard phase-forming powder having a composition consisting essentially of, in weight ratio, 7.5 to 25% of chromium, 0.3 to 3.0% of molybdenum, 0.25 to 2.4% of carbon, and 0.2 to 2.2% of vanadium and/or 1.0 to 5.0% of tungsten with the balance being iron, and inevitable impurities is used with a matrix-forming, partially diffused alloy powder having a composition consisting essentially of, in weight ratio, 1 to 10% of nickel, 1 to 3% of copper, and 0.4 to 1.0% of molybdenum with the balance being iron, and inevitable impurities.

The present invention provides a method of producing the sintered alloy according to the aforesaid fourth aspect wherein 0.1 to 2.0% by weight of a manganese sulfide powder is further mixed with the powder mixture used in any one of the production methods for the alloys according to the aforesaid first to third aspects.

The present invention provides a method of producing the sintered alloy according to the aforesaid fifth aspect wherein any one of an acrylic resin, lead or a lead alloy, and copper or a copper alloy is impregnated or infiltrated into pores in a sintered body obtained by forming and sintering the powder mixture used in any one of the production methods for the aforesaid first to fourth aspects.

DETAILED EXPLANATION OF THE PREFERRED EMBODIMENTS

Figure 1:
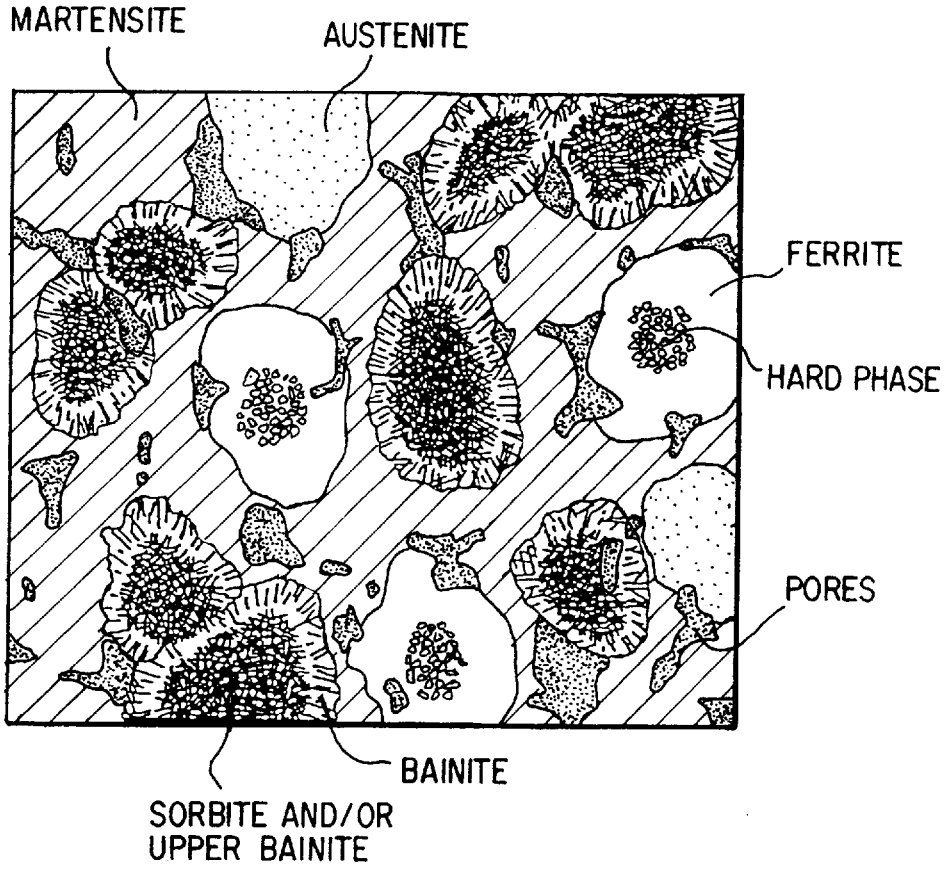
FIG. 1 is a schematic of one exemplary wear-resistant sintered alloy according to the present invention.
Figure 2:
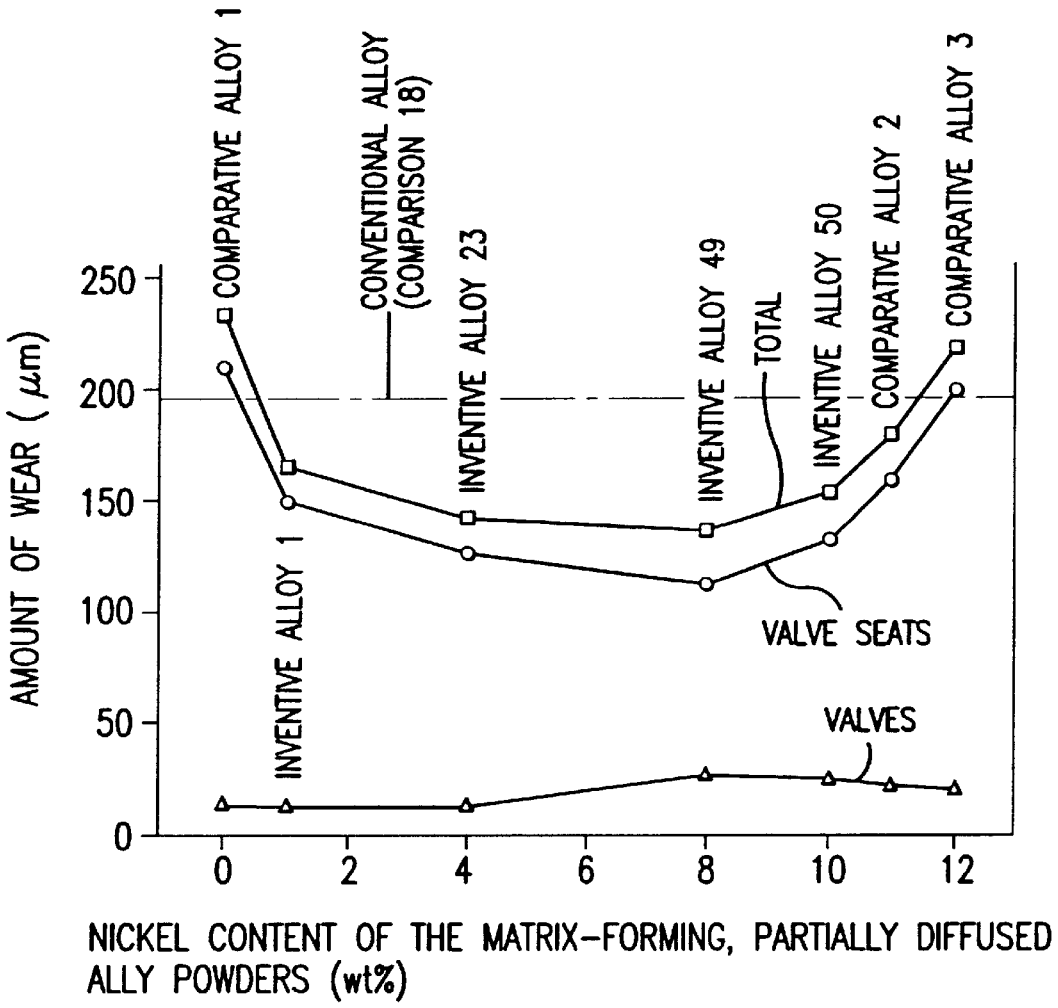
FIG. 2 is a graph showing the results of estimation of the amount of wear of some exemplary wear-resistant sintered alloys when the nickel content of the matrix-forming, partially diffused alloy powders are varied.
Figure 3:
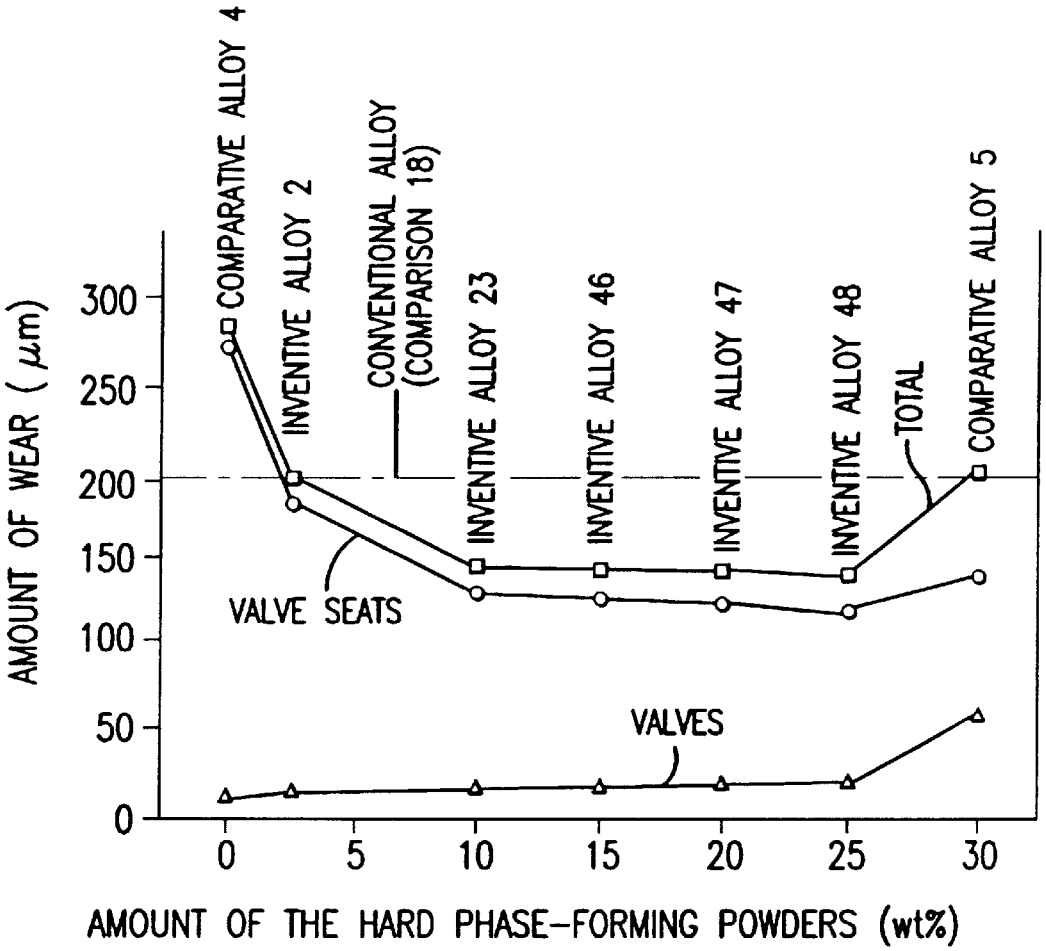
FIG. 3 is a graph showing the results of estimation of amount of wear when the amount of the hard phase-forming powders added is varied.

One exemplary metallic structure of the inventive sintered alloy according to the present invention is schematically shown in FIG. 1. The metallic structure of the sintered alloy will now be explained with reference to the quantitative limitations imposed on the respective components.

Martensite is a hard structure of high strength which favors wear resistance. However, the martensite is of high strength relative to a valve to come into sliding contact with a valve seat, and so makes an attack on the valve, resulting in an increased wearing of the valve. For this reason, the martensite is used in combination with bainite which is second in hardness and strength to the martensite to form a mixed structure, by virtue of which hardness is suitably regulated to ensure wear resistance and, at the same time, to reduce the attack on the valve.

The martensite and bainite are determined depending on the concentration of diffusion of elements such as nickel, molybdenum, and chromium, which enhance hardenability as will be described later. In other words, martensitic transformation occurs at a region richer in (or higher in concentration than) the elements favoring hardenability while bainitic transformation occurs at a region rich in the elements, although depending on what cooling rate is applied upon sintered. On the other hand, a region poor in such elements favoring hardenability remains in the form of sorbite, and upper bainite. Thus, a bainite having a nucleus of sorbite and/or bainite and surrounding the nucleus is formed.

In each of the sintered alloys according to the present invention, austenite enriched with toughness is dispersed into the aforesaid mixed structure of martensite and bainite, to thereby ensure the wear resistance and strength of the metallic structure itself, and improvements in toughness.

When the aforesaid mixed structure is obtained, it is not preferable to mix nickel and molybdenum powders with iron powders, because no sufficient martensite and bainite are obtained due to an unacceptably slow diffusion of molybdenum, and so it is likely that large amounts of pearlite and low-alloy ferrite which are poor in both strength and wear resistance may remain intact. In addition, bonding between powders due to diffusion becomes insufficient, resulting in a drop in toughness.

It is again not preferable to use perfect alloy powders having nickel and molybdenum provided to the iron matrix in the form of a perfect solid solution, because the components become homogeneous, failing to obtain any austenite phase. Furthermore, the perfect alloy powders are of reduced compressibility due to their own hardness, resulting in a sintered body of reduced strength.

For these reasons, the present invention makes use of a matrix-forming, partially diffused alloy powder having nickel and molybdenum partially diffused into, and bonded to, an iron powder for the purpose of forming the matrix structure. This enables the end structure to be achieved without detriment to compressibility.

In the thus obtained mixed structure, there is further dispersed the hard phase surrounding with a ferrite having a chromium concentration and composed mainly of chromium so as to achieve further improvements in wear resistance. This hard phase has a pin anchorage effect on reducing the plastic flow of the matrix which occurs when a valve is contact with a valve seat.

The ferrite having a high chromium concentration, because of being the ferrite of this material having high alloy elements and high strength, acts as a shock absorber when a valve face comes into contact with the hard phase so that it is less likely to make an attack on the valve, and is effective for preventing hard particles from falling off.

The hard phase surrounding with the ferrite having a high chromium concentration and composed mainly of chromium carbide is provided by the hard phase-forming powder. In other words, the chromium in the hard phase-forming powder is bonded to the carbon upon sintering to precipitate out the chromium carbide, so that the hard phase can be formed.

On the other hand, the chromium is diffused from the hard phase-forming powder into the matrix to enhance the hardenability of the matrix, and permit the ferrite having a high chromium concentration to be formed around the hard phase.

The hard phase-forming powder, if added in an amount of 3% or less, fails to form a sufficient hard phase and so makes no contribution to improvements in wear resistance. At 25% or more, on the other hand, the proportion of the ferrite having a high chromium concentration increases, resulting in drops of hardness and wear resistance. In addition, there is an increase in the proportion of the hard phase-forming powder, which otherwise gives rise to a compressibility drop. Moreover, if an alloy having a hard phase-forming powder content exceeding 25% is used to form a valve seat, that valve seat would cause an associated valve to wear away due to a vigorous attack thereon. Thus, the amount of the hard phase-forming powder added is limited to the range of 3 to 25%.

The nickel is provided in the form of the matrix-forming, partially diffused alloy powder which makes a contribution to improvements in the hardenability of the matrix structure, thereby subjecting the matrix to martensitic or bainitic transformation and enhancing the strength and wear resistance of the matrix. At a region where diffusion proceeds slowly, on the other hand, the nickel remains in the form of austenite, which contributes to improvements in the toughness of the matrix. However, when the nickel content of the matrix-forming, partially diffused alloy powder is less than 1%, it is impossible to achieve any sufficient increase in hardenability. When the nickel is added in an amount exceeding 10%, on the other hand, it is found that the amount of the remaining austenite becomes too large, resulting rather in drops of hardness, strength, and wear resistance. Thus, the amount of the nickel in the matrix-forming, partially diffused alloy powder is limited to the range of 1 to 10%.

The molybdenum in the matrix-forming, partially diffused alloy powder is effective not only to enhance the hardenability of the matrix structure but also to increase the hardness and strength of the matrix at high temperature. However, it is found that the molybdenum, when added in an amount less than 0.4%, fails to produce the aforesaid effect sufficiently, and when added in an amount exceeding 1.0%, causes the compressibility of the powder to drop, and an non-diffused portion to remain upon sintering, resulting in a drop of the mechanical properties of a sintered body. Thus, the amount of the molybdenum in the matrix-forming, partially diffused alloy powder is limited to the range of 0.4 to 0.6%.

When the molybdenum is provided in the form of a solid solution to the hard phase-forming powder, it generates a fine form of molybdenum carbide in the hard phase, and forms an eutectic carbide with chromium, as will be described later, thereby making a contribution to improvements in wear resistance. A part of the element which does not form the carbide forms a solid solution with the hard phase to thereby enhance the hardness and strength of the hard phase at high temperature.

It is found that the molybdenum, when added to the hard phase-forming powder in an amount less than 0.3%, fails to produce the aforesaid effect sufficiently, and when added in an amount exceeding 3.0%, causes the amount of the carbide to increase (if an alloy containing molybdenum in too large an amount is used to make a valve seat, that valve seat would cause an associated valve to wear away due to a vigorous attack thereon). Thus, when the molybdenum is provided in the form of a solid solution to the hard phase-forming powder, it is preferable that the amount of the molybdenum is limited to the range of 0.3 to 3.0%.

The copper is provided in the form of the matrix-forming, partially diffused alloy powder, and forms a solid solution with the matrix to enhance the strength and wear resistance thereof via the solid-solution hardening effect. However, it is found that the copper, when used in an amount less than 1%, fails to produce the aforesaid effect sufficiently, and when used in an amount exceeding 3%, causes coarse pores to increase upon the diffusion of copper, resulting in drops of mechanical properties such as strength. Thus, the copper content of the matrix-forming, partially diffused alloy powder is limited to the range of 1 to 3%.

In the hard phase-forming powder, the chromium reacts with carbon to generate hard chromium carbide in the hard phase, which contributes to improvements in wear resistance.

A part of the chromium is diffused from the hard phase-forming powder into the matrix to enhance the hardenability of the matrix, and to accelerate the martensitic or bainitic transformation of the matrix structure. The chromium, on the other hand, is a ferrite-stabilizing element which ensures that the phase surrounding the hard phase and having a high chromium concentration provides a ferrite phase without undergoing any martensitic transformation.

Here, if the chromium content is less than 4.0%, no sufficient amount of the carbide is achievable, nor is any contribution made to improvements in wear resistance. In addition, no sufficient ferrite phase is formed around the hard phase due to a reduced amount of the chromium diffused and the valve seat would become poor in the shock-absorbing effect upon an associated valve received thereon.

While, more than 25% of chromium is found to cause an increase in amount of the carbide resulting in more vigorous attack on the valve, friction of the valve and a drop in the compressibility of the hard phase-forming powder. Thus, the chromium content is limited to the range of 4.0 to 25%.

In the hard phase-forming powder, the vanadium and tungsten react with the carbon added to generate a fine form of carbides in the hard phase, to thereby enhance the wear resistance of the hard phase. In addition, these carbides are homogeneously diffused into the hard phase to thereby prevent the coarsening of the chromium carbide.

It is here found that when the vanadium and tungsten contents are less than 0.2% and 1.0%, respectively, the aforesaid effect becomes slender. If an alloy containing vanadium and tungsten in amounts exceeding 2.2% and 5.0%, respectively, is used to make a valve seat, that valve seat would cause an associated valve to wear away due to an increased amount of the carbides and, hence, a vigorous attack thereon. Thus, the vanadium and tungsten contents are limited to the ranges of 0.2 to 2.2% and 1.0 to 5.0%, respectively.

The carbon is used for the purpose of reinforcing the matrix structure by martensitic or bainitic transformation, and precipitating out carbides in the hard phase.

The amount of the carbon to be contained in the hard phase-forming powder lies within the range of 0.25 to 2.4%. When the carbon content of the hard phase-forming powder is less than 0.25%, no sufficient amounts of carbides precipitate out, and when it exceeds 2.4%, the powder becomes hard, posing some problems such as a drop of compressibility.

When the amount of the carbon to be added as graphite powder for the purpose of reinforcing the matrix is less than 0.5%, the matrix structure undergoes neither martensitic transformation nor bainitic transformation. At a carbon content exceeding 1.4%, on the other hand, the matrix does not only tend to contain an unsaturated solid solution, resulting in drops of toughness and machinability, but is also likely to generate a liquid phase upon sintering, which otherwise causes dimensional accuracy and quality stability to become worse. Thus, the amount of the carbon to be added as graphite powder is limited to the range of 0.5 to 1.4%.

The manganese sulfide or MnS is added to the raw materials upon blending to enhance machinability by diffusion into the matrix. When the amount of the manganese sulfide to be added is less than 0.1%, no effect upon the enhancement of machinability is achievable. At a manganese sulfide content exceeding 2.0%, on the other hand, compressibility drops, and sintering is inhibited, resulting in a drop of mechanical properties upon sintering. For these reasons, the amount of the manganese sulfide to be added is limited to the range of 0.1 to 2.0%.

The acrylic resin, lead or a lead alloy, and copper or a copper alloy remains incorporated in pores in a sintered alloy to ensure that the sintered alloy can be cut continuously rather than intermittently to absorb shocks on a cutting edge of tool during cutting, thereby preventing any possible damage to the cutting edge of tool and so improving the machinability of the sintered alloy. The lead or lead alloy, or copper or copper alloy, because of being soft by nature, can be deposited onto the tool face so that the cutting edge can be protected against any possible damage to thereby improve the machinability of the sintered alloy and increase the service life of the tool. In addition, they act as a solid lubricant between a valve seat and a valve face to thereby reduce the wearing of both the members. Furthermore, the copper or copper alloy, because of its high thermal conductivity, radiates off the heat generated at the cutting edge of tool during cutting, and so prevents any build-up of heat at the tool, thereby reducing damage to the cutting edge of tool.

EXAMPLES

The present invention will now be explained at great length with reference to a number of examples. In these examples, matrix-forming alloy powders (powder Nos. 1–7) having the compositions shown in Table 1, hard phase-forming powders (powder Nos. 1–39) having the compositions shown in Table 2, graphite powders, MnS powders, and a forming lubricant (zinc stearate) were blended together at the proportions shown in Tables 3 and 4. Each of the thus obtained blends was mixed for 30 minutes, followed by forming at a forming pressure of 6.5 ton/cm$^2$.

Then, the formed bodies were each sintered at 1,175° C. for 60 minutes in a dissociated ammonia gas to obtain inventive alloys 1–50 (sample Nos. 1–50) reported in Table 6, and comparative alloys (sample Nos. 1–15) reported in Table 7.

It is understood that pores in alloys 25–27 according to the present invention were impregnated or infiltrated with acrylic resin, lead, and copper after sintering.

Comparative alloys 16 and 17 having the compositions shown in Table 5 were obtained by blending discrete powders and perfect alloy powders at the proportions shown in Table 5 without the matrix-forming, partially diffused alloy powders according to the present invention, and mixing, forming, and sintering the obtained blends under the aforesaid conditions, and comparative alloy 18 was obtained treating the conventional alloy set forth in U.S. Pat. No. 1,043,124 under the same conditions.

Set out in Table 1 are the matrix-forming alloy powders used.

TABLE 1

| Matrix-Forming Alloy Powders | | | | | |
|---|---|---|---|---|---|
| Powder | Components (wt. %) | | | | |
| No. | Fe | Ni | Cu | Mo | Remarks |
| 1 | 96.5 | 3.0 | 1.5 | 1.0 | Ni-lower limit |
| 2 | 93.5 | 4.0 | 1.5 | 1.0 | |
| 3 | 89.5 | 8.0 | 1.5 | 1.0 | |
| 4 | 87.5 | 10.0 | 1.5 | 1.0 | Ni-upper limit |
| 5 | 97.5 | 0.0 | 1.5 | 1.0 | Ni-below lower limit |
| 6 | 86.5 | 11.0 | 1.5 | 1.0 | Ni-above upper limit |
| 7 | 85.5 | 12.0 | 1.5 | 1.0 | Ni-above upper limit |

Set out in Table 2 are the hard phase-forming powders used.

TABLE 2

| Hard Phase-Forming Powders | | | | | | | |
|---|---|---|---|---|---|---|---|
| Powder | Components (wt. %) | | | | | | |
| No. | Fe | Cr | Mo | V | W | C | Remarks |
| 1 | 93.1 | 4.0 | 1.0 | 0.5 | | 1.4 | Cr-lower limit |
| 2 | 92.1 | 5.0 | 1.0 | 0.5 | | 1.4 | |
| 3 | 89.1 | 8.0 | 1.0 | 0.5 | | 1.4 | |
| 4 | 86.6 | 12.0 | 0.0 | | | 1.4 | |
| 5 | 86.3 | 12.0 | 0.3 | | | 1.4 | Mo-lower limit |
| 6 | 86.0 | 12.0 | 0.6 | | | 1.4 | |
| 7 | 85.6 | 12.0 | 1.0 | | | 1.4 | |
| 8 | 85.1 | 12.0 | 1.0 | | 0.5 | 1.4 | W-lower limit |
| 9 | 84.6 | 12.0 | 1.0 | | 1.0 | 1.4 | |
| 10 | 83.6 | 12.0 | 1.0 | | 2.0 | 1.4 | |
| 11 | 82.6 | 12.0 | 1.0 | | 3.0 | 1.4 | |
| 12 | 81.6 | 12.0 | 1.0 | | 4.0 | 1.4 | |
| 13 | 81.1 | 12.0 | 1.0 | | 4.5 | 1.4 | |
| 14 | 80.6 | 12.0 | 1.0 | | 5.0 | 1.4 | W-upper limit |
| 15 | 85.4 | 12.0 | 1.0 | 0.2 | | 1.4 | V-lower limit |
| 16 | 86.3 | 12.0 | 1.0 | 0.5 | | 0.3 | C-lower limit |
| 17 | 85.9 | 12.0 | 1.0 | 0.5 | | 0.6 | |
| 18 | 85.5 | 12.0 | 1.0 | 0.5 | | 1.0 | |
| 19 | 85.1 | 12.0 | 1.0 | 0.5 | | 1.4 | |
| 20 | 84.5 | 12.0 | 1.0 | 0.5 | | 2.0 | |
| 21 | 84.1 | 12.0 | 1.0 | 0.5 | | 2.4 | Cr-upper limit |
| 22 | 84.1 | 12.0 | 1.0 | 0.5 | 1.0 | 1.4 | |
| 23 | 84.6 | 12.0 | 1.0 | 1.0 | | 1.4 | |
| 24 | 84.1 | 12.0 | 1.0 | 1.5 | | 1.4 | |
| 25 | 83.6 | 12.0 | 1.0 | 2.0 | | 1.4 | |
| 26 | 83.4 | 12.0 | 1.0 | 2.2 | | 1.4 | V-upper limit |
| 27 | 84.6 | 12.0 | 2.0 | | | 1.4 | |
| 28 | 83.6 | 12.0 | 3.0 | | | 1.4 | Mo-upper limit |
| 29 | 82.1 | 15.0 | 1.0 | 0.5 | | 1.4 | |
| 30 | 77.1 | 20.0 | 1.0 | 0.5 | | 1.4 | |
| 31 | 74.1 | 23.0 | 1.0 | 0.5 | | 1.4 | |
| 32 | 72.1 | 25.0 | 1.0 | 0.5 | | 1.4 | Cr-upper limit |
| 33 | 95.1 | 2.0 | 1.0 | 0.5 | | 1.4 | Cr-below lower limit |
| 34 | 71.1 | 26.0 | 1.0 | 0.5 | | 1.4 | Cr-above upper limit |
| 35 | 83.2 | 12.0 | 3.4 | | | 1.4 | Mo-above upper limit |
| 36 | 83.1 | 12.0 | 1.0 | 2.5 | | 1.4 | V-above upper limit |
| 37 | 79.6 | 12.0 | 1.0 | | 6.0 | 1.4 | W-above upper limit |
| 38 | 86.4 | 12.0 | 1.0 | 0.5 | | 0.1 | C-below lower limit |
| 39 | 83.9 | 12.0 | 1.0 | 0.5 | | 2.6 | C-above upper limit |

Set out in Table 3 the components (% by weight) of alloys of the present invention Nos. 1 to 50.

TABLE 3

| A No. | Components in % by weight: MFAP Powder No. | MFAP wt % | HPFP Powder No. | HPFP wt. % | GP wt. % | MnSP wt. % | FL wt. % | I/I | Remarks |
|---|---|---|---|---|---|---|---|---|---|
| 1 | 1 | 89.0 | 19 | 10.0 | 1.0 | | 0.5 | | Remarks 1 |
| 2 | 2 | 96.0 | 19 | 3.0 | 1.0 | | 0.5 | | Remarks 2 |
| 3 | 2 | 89.0 | 1 | 10.0 | 1.0 | | 0.5 | | Remarks 3 |
| 4 | 2 | 89.0 | 2 | 10.0 | 1.0 | | 0.5 | | |
| 5 | 2 | 89.0 | 3 | 10.0 | 1.0 | | 0.5 | | |
| 6 | 2 | 89.0 | 4 | 10.0 | 1.0 | | 0.5 | | |
| 7 | 2 | 89.0 | 5 | 10.0 | 1.0 | | 0.5 | | Remarks 4 |
| 8 | 2 | 89.0 | 6 | 10.0 | 1.0 | | 0.5 | | |
| 9 | 2 | 89.0 | 7 | 10.0 | 1.0 | | 0.5 | | |
| 10 | 2 | 89.0 | 8 | 10.0 | 1.0 | | 0.5 | | Remarks 5 |
| 11 | 2 | 89.0 | 9 | 10.0 | 1.0 | | 0.5 | | |
| 12 | 2 | 89.0 | 10 | 10.0 | 1.0 | | 0.5 | | |
| 13 | 2 | 89.0 | 11 | 10.0 | 1.0 | | 0.5 | | |
| 14 | 2 | 89.0 | 12 | 10.0 | 1.0 | | 0.5 | | |
| 15 | 2 | 89.0 | 13 | 10.0 | 1.0 | | 0.5 | | |
| 16 | 2 | 89.0 | 14 | 10.0 | 1.0 | | 0.5 | | Remarks 6 |
| 17 | 2 | 89.0 | 15 | 10.0 | 1.0 | | 0.5 | | Remarks 7 |
| 18 | 2 | 89.0 | 16 | 10.0 | 1.0 | | 0.5 | | Remarks 8 |
| 19 | 2 | 89.0 | 17 | 10.0 | 1.0 | | 0.5 | | |
| 20 | 2 | 89.0 | 18 | 10.0 | 1.0 | | 0.5 | | |
| 21 | 2 | 89.5 | 19 | 10.0 | 0.8 | | 0.5 | | Remarks 9 |
| 22 | 2 | 89.2 | 19 | 10.0 | 0.8 | | 0.5 | | |
| 23 | 2 | 89.0 | 19 | 10.0 | 1.0 | | 0.5 | | |
| 24 | 2 | 88.9 | 19 | 10.0 | 1.0 | 0.1 | 0.5 | | |
| 25 | 2 | 88.9 | 19 | 10.0 | 1.0 | 0.1 | 0.5 | | Remarks 10 |
| 26 | 2 | 88.9 | 19 | 10.0 | 1.0 | 0.1 | 0.5 | Pb | Remarks 11 |
| 27 | 2 | 88.9 | 19 | 10.0 | 1.0 | 0.1 | 0.5 | Cu | Remarks 12 |
| 28 | 2 | 88.2 | 19 | 10.0 | 1.0 | 0.8 | 0.5 | | |
| 29 | 2 | 87.6 | 19 | 10.0 | 1.0 | 1.4 | 0.5 | | |
| 30 | 2 | 87.0 | 19 | 10.0 | 1.0 | 2.0 | 0.5 | | Remarks 13 |
| 31 | 2 | 88.8 | 19 | 10.0 | 1.2 | | 0.5 | | |
| 32 | 2 | 88.6 | 19 | 10.0 | 1.4 | | 0.5 | | Remarks 14 |
| 33 | 2 | 89.0 | 20 | 10.0 | 1.0 | | 0.5 | | |
| 34 | 2 | 89.0 | 21 | 10.0 | 1.0 | | 0.5 | | Remarks 15 |
| 35 | 2 | 89.0 | 22 | 10.0 | 1.0 | | 0.5 | | |
| 36 | 2 | 89.0 | 23 | 10.0 | 1.0 | | 0.5 | | |
| 37 | 2 | 89.0 | 24 | 10.0 | 1.0 | | 0.5 | | |
| 38 | 2 | 89.0 | 25 | 10.0 | 1.0 | | 0.5 | | |
| 39 | 2 | 89.0 | 26 | 10.0 | 1.0 | | 0.5 | | Remarks 16 |
| 40 | 2 | 89.0 | 27 | 10.0 | 1.0 | | 0.5 | | |
| 41 | 2 | 89.0 | 28 | 10.0 | 1.0 | | 0.5 | | Remarks 17 |
| 42 | 2 | 89.0 | 29 | 10.0 | 1.0 | | 0.5 | | |
| 43 | 2 | 89.0 | 30 | 10.0 | 1.0 | | 0.5 | | |
| 44 | 2 | 89.0 | 31 | 10.0 | 1.0 | | 0.5 | | |
| 45 | 2 | 89.0 | 32 | 10.0 | 1.0 | | 0.5 | | Remarks 18 |
| 46 | 2 | 84.0 | 19 | 15.0 | 1.0 | | 0.5 | | |
| 47 | 2 | 79.0 | 19 | 20.0 | 1.0 | | 0.5 | | |
| 48 | 2 | 74.0 | 19 | 25.0 | 1.0 | | 0.5 | | Remarks 19 |
| 49 | 3 | 89.0 | 19 | 10.0 | 1.0 | | 0.5 | | |
| 50 | 4 | 89.0 | 19 | 10.0 | 1.0 | | 0.5 | | Remarks 20 |

MFAP: Matrix-forming, partially diffused alloy powders
HPFP: Hard phase-forming powders
GP: Amount of graphite powders added
MnSP: Amount of MsS powders added
FL: Amount of forming lubricant added
I/I: Impregnation/infiltration
A No: Alloy Nos. according to the present invention
Remarks 1: The partially diffused alloy powders contain nickel in its lower amount.
Remarks 2: The hard phase-forming powders are added in their lower limit amount.
Remarks 3: The hard phase-forming powders contain chromium in its lower limit amount.
Remarks 4: The hard phase-forming powders contain molybdenum in its lower limit amount.
Remarks 5: The hard phase-forming powders contain tungsten in its lower limit amount.
Remarks 6: The hard phase-forming powders contain tungsten in its upper limit amount.
Remarks 7: The hard phase-forming powders contain vanadium in its lower limit amount.
Remarks 8: The hard phase-forming powders contain carbon in its lower limit amount.
Remarks 9: The graphite powders are added in their lower limit amount.
Remarks 10: Impregnated with acrylic resin.

TABLE 3-continued

Remarks 11: Impregnated with lead.
Remarks 12: Impregnated with copper.
Remarks 13: The MnS powders are added in their upper limit amount.
Remarks 14: The graphite powders are added in their upper limit amount.
Remarks 15: The hard phase-forming powders contain carbon in its upper limit.
Remarks 16: The hard phase-forming powders contain vanadium its upper limit amount.
Remarks 17: The hard phase-forming powders contain molybdenum in its upper limit amount
Remarks 18: The hard phase-forming powders contain chromium in its upper limit amount.
Remarks 19: The hard phase-forming powders are added in their upper limit amount.
Remarks 20: The partially diffused alloy powders contain nickel in its upper limit amount.

Set out in Table 4 are the components in % by weight of comparative alloys 1 to 11.

TABLE 4

| Comparative alloy No. | Components in % by weight | | | | | | | Remarks |
|---|---|---|---|---|---|---|---|---|
| | MFAP | | HPFP | | GP | MnSP | FL | |
| | Powder No. | wt. % | Powder No. | wt. % | wt. % | wt. % | wt. % | |
| 1 | 5 | 89.0 | 19 | 10.0 | 1.0 | | 0.5 | Remarks 1 |
| 2 | 6 | 89.0 | 19 | 10.0 | 1.0 | | 0.5 | Remarks 2 |
| 3 | 7 | 89.0 | 19 | 10.0 | 1.0 | | 0.5 | Remarks 3 |
| 4 | 2 | 99.0 | | | 1.0 | | 0.5 | Remarks 4 |
| 5 | 2 | 69.0 | 19 | 30.0 | 1.0 | | 0.5 | Remarks 5 |
| 6 | 2 | 89.0 | 33 | 10.0 | 1.0 | | 0.5 | Remarks 6 |
| 7 | 2 | 89.0 | 34 | 10.0 | 1.0 | | 0.5 | Remarks 7 |
| 8 | 2 | 89.0 | 35 | 10.0 | 1.0 | | 0.5 | Remarks 8 |
| 9 | 2 | 89.0 | 36 | 10.0 | 1.0 | | 0.5 | Remarks 9 |
| 10 | 2 | 89.0 | 37 | 10.0 | 1.0 | | 0.5 | Remarks 10 |
| 11 | 2 | 89.0 | 38 | 10.0 | 1.0 | | 0.5 | Remarks 11 |
| 12 | 2 | 89.0 | 39 | 10.0 | 1.0 | | 0.5 | Remarks 12 |
| 13 | 2 | 89.7 | 19 | 10.0 | 0.3 | | 0.5 | Remarks 13 |
| 14 | 2 | 88.3 | 19 | 10.0 | 1.7 | | 0.5 | Remarks 14 |
| 15 | 2 | 86.5 | 19 | 10.0 | 1.0 | 2.5 | 0.5 | Remarks 15 |

MFAP: Matrix-forming, partially diffused alloy powders
HPFP: Hard phase-forming powders
GP: Amount of graphite powders added
MnSP: Amount of MnS powders added
FL: Amount of forming lubricant added
Remarks 1: The partially diffused alloy powders contain nickel in an amount below its lower limit.
Remarks 2: The partially diffused alloy powders contain nickel in an amount above its upper limit.
Remarks 3: The partially diffused alloy powders contain nickel in an amount above its upper limit.
Remarks 4: The hard phase-forming alloys are added in an amount below their lower limit.
Remarks 5: The hard phase-forming alloys are added in an amount above their upper limit.
Remarks 6: The hard phase-forming powders contain chromium in an amount below its lower limit.
Remarks 7: The hard phase-forming powders contain chromium in an amount above its upper limit.
Remarks 8: The hard phase-forming powders contain molybdenum in an amount above its upper limit.
Remarks 9: The hard phase-forming powders contain vanadium in an amount above its upper limit.
Remarks 10: The hard phase-forming powders contain tungsten in an amount above its upper limit.
Remarks 11: The hard phase-forming powders contain carbon in an amount below its lower limit.
Remarks 12: The hard phase-forming powders contain carbon in an amount above its upper limit.
Remarks 13: The graphite powders are added in an amount below their lower limit.
Remarks 14: The graphite powders are added in an amount above their upper limit.
Remarks 15: The MnS powders are added in an amount above their upper limit.

Set out in Table 5 are the components in % by weight of comparative alloys 16–18.

TABLE 5

| Comparative alloy No. | Components in % by weight: Amount of pure Fe powders wt. % | Amount of Ni powders wt.% | Amount of Cu powders wt. % | Amount of Mo powders wt. % | Amount of Fe-4Ni-1.5Cu alloy powders wt. % | Amount of Fe-6.5Co-1.5Ni-1.5Mo alloy powders wt.% | Hard phase-forming powders: Powder No. | Hard phase-forming powders: Amount wt. % | Amount of graphite powders wt. % | Amount of forming lubricant wt. % | Remarks |
|---|---|---|---|---|---|---|---|---|---|---|---|
| 16 | 83.0 | 4.0 | 1.5 | 0.5 | | | 19 | 10.0 | 1.0 | 0.5 | Remarks 1 |
| 17 | | | | | 88.6 | | 19 | 10.0 | 1.0 | 0.5 | Remarks 2 |
| 18 | | | | | | 99.2 | | | 0.8 | | Remarks 3 |

Remarks 1: Discrete powders + Hard phase-forming powders
Remarks 2: Perfect alloy powders + Hard phase-forming powders
Remarks 3: Conventional alloy (Patent No. 1043124 alloy)

Set out in Table 6 are the general compositions of inventive alloys 1 to 50.

TABLE 6

| A No. | Components in % by weight: Fe | Ni | Cu | Mo | Cr | V | W | C | Co | MnS | Remarks |
|---|---|---|---|---|---|---|---|---|---|---|---|
| 1 | 94.40 | 0.89 | 0.89 | 1.44 | 1.20 | 0.05 | | 1.14 | | | Remarks 1 |
| 2 | 92.31 | 3.84 | 0.96 | 1.47 | 0.36 | 0.02 | | 1.04 | | | Remarks 2 |
| 3 | 92.53 | 3.56 | 0.89 | 1.44 | 0.40 | 0.05 | | 1.14 | | | Remarks 3 |
| 4 | 92.43 | 3.56 | 0.89 | 1.44 | 0.50 | 0.05 | | 1.14 | | | |
| 5 | 92.13 | 3.56 | 0.89 | 1.44 | 0.80 | 0.05 | | 1.14 | | | |
| 6 | 91.88 | 3.56 | 0.89 | 1.34 | 1.20 | | | 1.14 | | | |
| 7 | 91.85 | 3.56 | 0.89 | 1.37 | 1.20 | | | 1.14 | | | Remarks 4 |
| 8 | 91.82 | 3.56 | 0.89 | 1.40 | 1.20 | | | 1.14 | | | |
| 9 | 91.78 | 3.56 | 0.89 | 1.44 | 1.20 | | | 1.14 | | | |
| 10 | 91.73 | 3.56 | 0.89 | 1.44 | 1.20 | | 0.05 | 1.14 | | | Remarks 5 |
| 11 | 91.68 | 3.56 | 0.89 | 1.44 | 1.20 | | 0.10 | 1.14 | | | |
| 12 | 91.58 | 3.56 | 0.89 | 1.44 | 1.20 | | 0.20 | 1.14 | | | |
| 13 | 91.48 | 3.56 | 0.89 | 1.44 | 1.20 | | 0.30 | 1.14 | | | |
| 14 | 91.38 | 3.56 | 0.89 | 1.44 | 1.20 | | 0.40 | 1.14 | | | |
| 15 | 91.33 | 3.56 | 0.89 | 1.44 | 1.20 | | 0.45 | 1.14 | | | |
| 16 | 91.28 | 3.56 | 0.89 | 1.44 | 1.20 | | 0.50 | 1.14 | | | Remarks 6 |
| 17 | 91.76 | 3.56 | 0.89 | 1.44 | 1.20 | 0.02 | | 1.14 | | | Remarks 7 |
| 18 | 91.84 | 3.56 | 0.89 | 1.44 | 1.20 | 0.05 | | 1.03 | | | Remarks 8 |
| 19 | 91.81 | 3.56 | 0.89 | 1.44 | 1.20 | 0.05 | | 1.06 | | | Remarks 9 |
| 20 | 91.77 | 3.56 | 0.89 | 1.44 | 1.20 | 0.05 | | 1.10 | | | Remarks 10 |
| 21 | 92.19 | 3.58 | 0.90 | 1.44 | 1.20 | 0.05 | | 0.64 | | | Remarks 11 |
| 22 | 91.91 | 3.57 | 0.89 | 1.44 | 1.20 | 0.05 | | 0.94 | | | |
| 23 | 91.73 | 3.56 | 0.89 | 1.44 | 1.20 | 0.05 | | 1.14 | | | |
| 24 | 91.63 | 3.56 | 0.89 | 1.43 | 1.20 | 0.05 | | 1.14 | | 0.10 | |
| 25 | 91.63 | 3.56 | 0.89 | 1.43 | 1.20 | 0.05 | | 1.14 | | 0.10 | Remarks 12 |
| 26 | 91.63 | 3.56 | 0.89 | 1.43 | 1.20 | 0.05 | | 1.14 | | 0.10 | Remarks 13 |
| 27 | 91.63 | 3.56 | 0.89 | 1.43 | 1.20 | 0.05 | | 1.14 | | 0.10 | Remarks 14 |
| 28 | 90.98 | 3.53 | 0.88 | 1.42 | 1.20 | 0.05 | | 1.14 | | 0.80 | |
| 29 | 90.42 | 3.50 | 0.88 | 1.41 | 1.20 | 0.05 | | 1.14 | | 1.40 | |
| 30 | 89.86 | 3.48 | 0.87 | 1.41 | 1.20 | 0.05 | | 1.14 | | 2.00 | Remarks 15 |
| 31 | 91.54 | 3.55 | 0.89 | 1.43 | 1.20 | 0.05 | | 1.34 | | | |
| 32 | 91.35 | 3.54 | 0.89 | 1.43 | 1.20 | 0.05 | | 1.54 | | | Remarks 16 |
| 33 | 91.67 | 3.56 | 0.89 | 1.44 | 1.20 | 0.05 | | 1.20 | | | |
| 34 | 91.63 | 3.56 | 0.89 | 1.44 | 1.20 | 0.05 | | 1.24 | | | Remarks 17 |
| 35 | 91.63 | 3.56 | 0.89 | 1.44 | 1.20 | 0.05 | 0.10 | 1.14 | | | |
| 36 | 91.68 | 3.56 | 0.89 | 1.44 | 1.20 | 0.10 | | 1.14 | | | |
| 37 | 91.63 | 3.56 | 0.89 | 1.44 | 1.20 | 0.15 | | 1.14 | | | |
| 38 | 91.58 | 3.56 | 0.89 | 1.44 | 1.20 | 0.20 | | 1.14 | | | |
| 39 | 91.56 | 3.56 | 0.89 | 1.44 | 1.20 | 0.22 | | 1.14 | | | Remarks 18 |
| 40 | 91.68 | 3.56 | 0.89 | 1.54 | 1.20 | | | 1.14 | | | |
| 41 | 91.58 | 3.56 | 0.89 | 1.64 | 1.20 | | | 1.14 | | | Remarks 19 |
| 42 | 91.43 | 3.56 | 0.89 | 1.44 | 1.50 | 0.05 | | 1.14 | | | |
| 43 | 90.93 | 3.56 | 0.89 | 1.44 | 2.00 | 0.05 | | 1.14 | | | |
| 44 | 90.63 | 3.56 | 0.89 | 1.44 | 2.30 | 0.05 | | 1.14 | | | |
| 45 | 90.43 | 3.56 | 0.89 | 1.44 | 2.50 | 0.05 | | 1.14 | | | |
| 46 | 91.31 | 3.36 | 0.84 | 1.41 | 1.80 | 0.08 | | 1.21 | | | Remarks 20 |
| 47 | 90.89 | 3.16 | 0.79 | 1.39 | 2.40 | 0.10 | | 1.28 | | | |
| 48 | 90.47 | 2.96 | 0.74 | 1.36 | 3.00 | 0.13 | | 1.35 | | | Remarks 21 |
| 49 | 88.17 | 7.12 | 0.89 | 1.44 | 1.20 | 0.05 | | 1.14 | | | |

TABLE 6-continued

| A | Components in % by weight | | | | | | | | | | |
|---|---|---|---|---|---|---|---|---|---|---|---|
| No. | Fe | Ni | Cu | Mo | Cr | V | W | C | Co | MnS | Remarks |
| 50 | 86.39 | 8.90 | 0.89 | 1.44 | 1.20 | 0.05 | | 1.14 | | | Remarks 22 |

A No.: Alloy Nos. according to the present invention
Remarks 1: The partially diffused alloy powders contain nickel in its lower limit amount.
Remarks 2: The hard phase-forming powders are added in their lower limit amount.
Remarks 3: The hard phase-forming powders contain chromium in its lower limit amount.
Remarks 4: The hard phase-forming powders contain molybdenum in its lower limit amount.
Remarks 5: The hard phase-forming powders contain tungsten in its lower limit amount.
Remarks 6: The hard phase-forming powders contain tungsten in its upper limit amount.
Remarks 7: The hard phase-forming powders contain vanadium in its lower limit amount.
Remarks 8: The hard phase-forming powders contain carbon in its lower limit amount.
Remarks 9: The hard phase-forming powders contain carbon in its lower limit amount.
Remarks 10: The hard phase-forming powders contain carbon in its lower limit amount.
Remarks 11: The graphite powders are added in their lower limit amount.
Remarks 12: Impregnated with acrylic resin.
Remarks 13: Impregnated with lead.
Remarks 14: Infiltrated with copper.
Remarks 15: The MnS powders are added in their upper limit amount.
Remarks 16: The graphite powders are added in their upper limit amount.
Remarks 17: The hard phase-forming powders contain copper in its upper limit amount.
Remarks 18: The hard phase-forming powders contain vanadium in its upper limit amount.
Remarks 19: The hard phase-forming powders contain molybdenum in its upper limit amount.
Remarks 20: The hard phase-forming powders contain chromium in its upper limit amount.
Remarks 21: The hard phase-forming powders are added in their upper limit amount.
Remarks 22: The partially diffused alloy powders contain nickel in its upper limit.

Set out in Table 7 are the general compositions of comparative alloys 1–18.

TABLE 7

| Comparative | Components in % by weight | | | | | | | | | | |
|---|---|---|---|---|---|---|---|---|---|---|---|
| alloy No. | Fe | Ni | Cu | Mo | Cr | V | W | C | Co | MnS | Remarks |
| 1 | 95.29 | | 0.89 | 1.44 | 1.20 | 0.05 | | 1.14 | | | Remarks 1 |
| 2 | 85.50 | 9.79 | 0.89 | 1.44 | 1.20 | 0.05 | | 1.14 | | | Remarks 2 |
| 3 | 84.61 | 10.68 | 0.89 | 1.44 | 1.20 | 0.05 | | 1.14 | | | Remarks 3 |
| 4 | 92.57 | 3.96 | 0.99 | 1.49 | | | | 1.00 | | | Remarks 4 |
| 5 | 90.05 | 2.76 | 0.69 | 1.34 | 3.60 | 0.15 | | 1.42 | | | Remarks 5 |
| 6 | 92.73 | 3.56 | 0.89 | 1.44 | 0.20 | 0.05 | | 1.14 | | | Remarks 6 |
| 7 | 90.33 | 3.56 | 0.89 | 1.44 | 2.60 | 0.05 | | 1.14 | | | Remarks 7 |
| 8 | 91.54 | 3.56 | 0.89 | 1.68 | 1.20 | | | 1.14 | | | Remarks 8 |
| 9 | 91.53 | 3.56 | 0.89 | 1.44 | 1.20 | 0.25 | | 1.14 | | | Remarks 9 |
| 10 | 91.18 | 3.56 | 0.89 | 1.44 | 1.20 | | 0.60 | 1.14 | | | Remarks 10 |
| 11 | 91.86 | 3.56 | 0.89 | 1.44 | 1.20 | 0.05 | | 1.01 | | | Remarks 11 |
| 12 | 91.61 | 3.56 | 0.89 | 1.44 | 1.20 | 0.05 | | 1.26 | | | Remarks 12 |
| 13 | 92.38 | 3.59 | 0.90 | 1.45 | 1.20 | 0.05 | | 0.44 | | | Remarks 13 |
| 14 | 91.07 | 3.53 | 0.88 | 1.42 | 1.20 | 0.05 | | 1.84 | | | Remarks 14 |
| 15 | 89.39 | 3.46 | 0.87 | 1.40 | 1.20 | 0.05 | | 1.14 | | 2.50 | Remarks 15 |
| 16 | 91.51 | 4.00 | 1.50 | 0.60 | 1.20 | 0.05 | | 1.14 | | | Remarks 16 |
| 17 | 91.50 | 4.00 | 1.50 | 0.60 | 1.20 | 0.05 | | 1.14 | | | Remarks 17 |
| 18 | 89.78 | 1.49 | | 1.49 | | | | 0.80 | 6.45 | | Remarks 18 |

Remarks 1: The partially diffused alloy powders contain nickel in an amount below its lower limit.
Remarks 2: The partially diffused alloy powders contain nickel in an amount above its upper limit.
Remarks 3: The partially diffused alloy powders contain nickel in an amount above its upper limit.
Remarks 4: The hard phase-forming powders are added in an amount below their lower limit.
Remarks 5: The hard phase-forming powders are added in an amount above their upper limit.
Remarks 6: The hard phase-forming powders contain chromium in an amount below its lower limit.
Remarks 7: The hard phase-forming powders contain chromium in an amount above its upper limit.
Remarks 8: The hard phase-forming powders contain molybdenum in an amount above its upper limit.
Remarks 9: The hard phase-forming powders contain vanadium in an amount above its upper limit.
Remarks 10: The hard phase-forming powders contain tungsten in an amount above its upper limit.
Remarks 11: The hard phase-forming powders contain carbon in an amount below its lower limit.
Remarks 12: The hard phase-forming powders contain carbon in an amount above its upper limit.
Remarks 13: The graphite powders are added in an amount below their lower limit.
Remarks 14: The graphite powders are added in an amount above their upper limit.
Remarks 15: The MnS powders are added in an amount above their upper limit.
Remarks 16: Discrete powders + Hard phase-forming powders
Remarks 17: Perfect alloy powders + Hard phase-forming powders
Remarks 18: Conventional alloy (Patent No. 1043124 alloy)

The aforesaid sintered alloys were subjected to apparent hardness, radial crushing strength, machinability, and wear resistance tests. The results are all reported in Tables 8 and 9.

In Tables 3, 4, and 7–9 the matrix-forming, partially diffused alloy powders are referred to as the partially diffused alloy powders for reasons of space.

In the machinability test, a bench drill was used to make holes in a specimen due to the weight of its rotating portion plus an additional weight, thereby making estimation of how many holes could be made. In this test, a specimen having a preset thickness of 5 mm was drilled under a load of 1.8 kg, using a cemented carbide drill of 3 mm in diameter.

In the wear resistance testing, a sintered alloy formed into valve sheet shape was fitted under pressure in an aluminum alloy housing. Then, vertical piston motion was applied to a valve by the rotation of an eccentric cam caused by driving a motor so that the face and sheet planes of the valve were repeatedly collided with the valve seat for a certain period of time, thereby making estimation of the weight lost from both the valve seat and the valve. During the test, temperature control was done by heating the umbrella of the valve by means of a burner. In this test, the eccentric cam was rotated at 3,000 rpm, the portion of the valve sheet to be tested was preset at 250° C. for a repetition time of 10 hours.

The results of estimation of alloys 1 to 50 according to the present invention are reported in Table 8.

TABLE 8

| | What is estimated | | | | | | |
|---|---|---|---|---|---|---|---|
| | | | | Abrasion by Wearing Test | | | |
| A No. | Apparent hardness HRA | Ring crushing strength MPa | HSMT | Seats μm | Valves μm | Total μm | Remarks |
| 1 | 60 | 851 | 4 | 150 | 15 | 165 | Remarks 1 |
| 2 | 61 | 900 | 1 | 180 | 12 | 192 | Remarks 2 |
| 3 | 59 | 856 | 1 | 148 | 10 | 158 | Remarks 3 |
| 4 | 60 | 868 | 1 | 141 | 10 | 151 | |
| 5 | 61 | 876 | 0 | 131 | 12 | 143 | |
| 6 | 58 | 911 | 1 | 166 | 11 | 177 | |
| 7 | 59 | 905 | 0 | 151 | 11 | 162 | Remarks 4 |
| 8 | 60 | 896 | 0 | 149 | 12 | 161 | |
| 9 | 60 | 890 | 0 | 147 | 12 | 159 | |
| 10 | 62 | 884 | 0 | 130 | 15 | 145 | Remarks 5 |
| 11 | 62 | 880 | 0 | 126 | 16 | 142 | |
| 12 | 63 | 871 | 0 | 120 | 16 | 136 | |
| 13 | 64 | 867 | 0 | 116 | 18 | 134 | |
| 14 | 64 | 862 | 0 | 119 | 18 | 137 | |
| 15 | 63 | 857 | 0 | 122 | 20 | 142 | |
| 16 | 62 | 846 | 0 | 124 | 23 | 147 | Remarks 6 |
| 17 | 61 | 882 | 0 | 133 | 12 | 145 | Remarks 7 |
| 18 | 59 | 900 | 0 | 142 | 10 | 152 | Remarks 8 |
| 19 | 60 | 894 | 0 | 138 | 12 | 150 | Remarks 9 |
| 20 | 62 | 886 | 0 | 132 | 14 | 146 | Remarks 10 |
| 21 | 60 | 850 | 1 | 146 | 12 | 158 | Remarks 11 |
| 22 | 61 | 864 | 0 | 135 | 13 | 148 | |
| 23 | 62 | 879 | 0 | 128 | 15 | 143 | |
| 24 | 60 | 820 | 3 | 132 | 15 | 147 | |
| 25 | 61 | 824 | 15 | 130 | 10 | 140 | Remarks 12 |
| 26 | 62 | 830 | 14 | 135 | 11 | 146 | Remarks 13 |
| 27 | 64 | 845 | 7 | 128 | 12 | 140 | Remarks 14 |
| 28 | 56 | 780 | 4 | 150 | 16 | 166 | |
| 29 | 54 | 750 | 6 | 165 | 17 | 182 | |
| 30 | 52 | 710 | 6 | 179 | 20 | 199 | Remarks 15 |
| 31 | 63 | 894 | 0 | 134 | 16 | 150 | |
| 32 | 65 | 865 | 0 | 142 | 17 | 159 | Remarks 16 |
| 33 | 64 | 862 | 0 | 120 | 18 | 138 | |
| 34 | 63 | 853 | 0 | 118 | 21 | 139 | Remarks 17 |

TABLE 8-continued

| | What is estimated | | | | | | |
|---|---|---|---|---|---|---|---|
| | | | | Abrasion by Wearing Test | | | |
| A No. | Apparent hardness HRA | Ring crushing strength MPa | HSMT | Seats μm | Valves μm | Total μm | Remarks |
| 35 | 64 | 863 | 0 | 123 | 17 | 140 | |
| 36 | 62 | 876 | 0 | 124 | 15 | 139 | |
| 37 | 63 | 872 | 0 | 120 | 18 | 138 | |
| 38 | 63 | 864 | 0 | 118 | 18 | 136 | |
| 39 | 62 | 852 | 0 | 121 | 20 | 141 | Remarks 18 |
| 40 | 61 | 881 | 0 | 141 | 18 | 159 | |
| 41 | 62 | 864 | 0 | 139 | 23 | 162 | Remarks 19 |
| 42 | 63 | 882 | 0 | 126 | 15 | 141 | |
| 43 | 62 | 873 | 0 | 129 | 18 | 147 | |
| 44 | 61 | 850 | 0 | 134 | 23 | 157 | |
| 45 | 60 | 840 | 0 | 146 | 28 | 174 | Remarks 20 |
| 46 | 61 | 840 | 0 | 126 | 16 | 142 | |
| 47 | 61 | 820 | 0 | 123 | 18 | 141 | |
| 48 | 60 | 800 | 0 | 120 | 20 | 140 | Remarks 21 |
| 49 | 64 | 902 | 0 | 113 | 27 | 140 | |
| 50 | 60 | 873 | 0 | 132 | 24 | 156 | Remarks 22 |

A No.: Alloy Nos. according to the present invention

HSMT: Number of holes made by simple machinability test

Remarks 1: The partially diffused alloy powders contain nickel in its lower limit amount.

Remarks 2: The hard phase-forming powders are added in their lower limit amount.

Remarks 3: The hard phase-forming powders contain chromium in its lower limit amount.

Remarks 4: The hard phase-forming powders contain molybdenum in its lower limit amount.

Remarks 5: The hard phase-forming powders contain tungsten in its lower limit amount.

Remarks 6: The hard phase-forming powders contain tungsten in its upper limit amount.

Remarks 7: The hard phase-forming powders contain vanadium in its lower limit amount.

Remarks 8: The hard phase-forming powders contain carbon in its lower limit amount.

Remarks 9: The hard phase-forming powders contain carbon in its lower limit amount.

Remarks 10: The hard phase-forming powders contain carbon in its lower limit amount.

Remarks 11: The graphite powders are added in their lower limit amount.

Remarks 12: Impregnated with acrylic resin.

Remarks 13: Impregnated with lead.

Remarks 14: Infiltrated with copper.

Remarks 15: The MnS powders are added in their upper limit amount.

Remarks 16: The graphite powders are added in their upper limit amount.

Remarks 17: The hard phase-forming powders contain copper in its upper limit amount.

Remarks 8: The hard phase-forming powders contain vanadium in its upper limit amount.

Remarks 19: The hard phase-forming powders contain molybdenum in its upper limit amount.

Remarks 20: The hard phase-forming powders contain chromium in its upper limit amount.

Remarks 21: The hard phase-forming powders are added in their upper limit amount.

Remarks 22: The partially diffused alloy powders contain nickel in its upper limit.

The results of estimation of comparative alloys 1–18 are set out in Table 9.

TABLE 9

| Comparative alloy No. | What is estimated: Apparent hardness HRA | Ring crushing strength MPa | HSMT | Abrasion by Wearing Tests: Seats μm | Valves μm | Total μm | Remarks |
|---|---|---|---|---|---|---|---|
| 1 | 56 | 800 | 25 | 220 | 14 | 234 | Remarks 1 |
| 2 | 58 | 855 | 3 | 159 | 20 | 179 | Remarks 2 |
| 3 | 55 | 824 | 21 | 200 | 20 | 220 | Remarks 3 |
| 4 | 62 | 1093 | 3 | 273 | 10 | 283 | Remarks 4 |
| 5 | 57 | 750 | 0 | 140 | 60 | 200 | Remarks 5 |
| 6 | 57 | 840 | 3 | 194 | 10 | 204 | Remarks 6 |
| 7 | 57 | 800 | 1 | 187 | 70 | 257 | Remarks 7 |
| 8 | 60 | 834 | 0 | 158 | 54 | 212 | Remarks 8 |
| 9 | 59 | 874 | 0 | 149 | 48 | 197 | Remarks 9 |
| 10 | 58 | 811 | 0 | 164 | 51 | 215 | Remarks 10 |
| 11 | 57 | 907 | 0 | 180 | 8 | 188 | Remarks 11 |
| 12 | 60 | 833 | 0 | 126 | 48 | 174 | Remarks 12 |
| 13 | 58 | 800 | 2 | 226 | 10 | 236 | Remarks 13 |
| 14 | 66 | 780 | 0 | 169 | 35 | 204 | Remarks 14 |
| 15 | 45 | 590 | 7 | 230 | 25 | 255 | Remarks 15 |
| 16 | 60 | 818 | 3 | 166 | 17 | 183 | Remarks 16 |
| 17 | 58 | 777 | 0 | 192 | 12 | 204 | Remarks 17 |
| 18 | 62 | 780 | 8 | 180 | 18 | 198 | Remarks 18 |

HSMT: Number of holes made by simple machinability test
Remarks 1: The partially diffused alloy powders contain nickel in an amount below its lower limit.
Remarks 2: The partially diffused alloy powders contain nickel in an amount above its upper limit.
Remarks 3: The partially diffused alloy powders contain nickel in an amount above its upper limit.
Remarks 4: The hard phase-forming powders are added in an amount below their lower limit.
Remarks 5: The hard phase-forming powders are added in an amount above their upper limit.
Remarks 6: The hard phase-forming powders contain chromium in an amount below its lower limit.
Remarks 7: The hard phase-forming powders contain chromium in an amount above its upper limit.
Remarks 8: The hard phase-forming powders contain molybdenum in an amount above its upper limit.
Remarks 9: The hard phase-forming powders contain vanadium in an amount above its upper limit.
Remarks 10: The hard phase-forming powders contain tungsten in an amount above its upper limit.
Remarks 11: The hard phase-forming powders contain carbon in an amount below its lower limit.
Remarks 12: The hard phase-forming powders contain carbon in an amount above its upper limit.
Remarks 13: The graphite powders are added in an amount below their lower limit.
Remarks 14: The graphite powders are added in an amount above their upper limit.
Remarks 15: The MnS powders are added in an amount above their upper limit.
Remarks 16: Discrete powders + Hard phase-forming powders
Remarks 17: Perfect alloy powders + Hard phase-forming powders
Remarks 18: Conventional alloy (Patent No. 1043124 alloy)

From Tables 8 and 9, the following are found. In FIGS. 2 to 8 that are graphs showing the results of estimation of wear resistance alone, triangular, cross, and square plots indicate the amount of wear of valves, the amount of wear of valve seats, and the total amount of wear of the valves and valve seats. In these figures, the total amount of wear of the valve and valve seat made from a conventional alloy (Comparison 18) is also indicated. It is here to be noted that the alloy 1 according to the present invention and comparative alloy 1, for instance, are referred to as Invention 1 and Comparison 1. In the following explanation, % will be given by weight unless otherwise noted.

Examination was made of what occurred with the alloys 1, 23, 49 and 50 according to the present invention, and comparative alloys 1–3, when the amount of nickel in the matrix-forming, partially diffused alloy powders was varied.

As the amount of nickel increases, hardness (HRA), radial crushing strength (MPa), and the amount of wear (μm) of valve seats increases due to an increase in the amount of martensite. At more than 8%, however, they decrease conversely due to an increased austenite phase. As can be seen from FIG. 2, the amount of wear of valves increases gradually until the amount of nickel reaches 8%, because the martensite of valve seats increases. Even at more than 8%, there is no substantial change in the amount of wear of valves due to an increase in the amount of austenite in the valve seat structure. Thus, it is found that the total amount of wear of valves and valve seats has a stable yet low value as long as the amount of nickel is kept between 1% and 10%, but tends to increase upon the amount of nickel exceeding 10%. This is the reason the nickel content of the matrix-forming, partially diffused alloy powders is limited to the range of 1 to 10%.

By comparisons of the alloys 2, 23, and 46–48 according to the present invention with comparative alloys 4 and 5, it is possible to see the influences that the amount of the hard phase-forming powders added has on hardness, radial crushing strength, and wear resistance.

It is found that the radial crushing strength decreases with an increase in the amount of the hard phase-forming powders added, but the hardness undergoes no substantial change, and then decreases after the amount of the hard phase-forming powders added reaches a certain value. To be more specific, the hardness decreases due to an increase of the hard phase of low strength and the ferrite phase surrounding the hard phase, but the hardness decrease is more or less made up for by an increase in the amount of the hard phase, and so tends to be kept low. Upon the amount of the hard phase-forming powders added exceeding 20%, however, the hardness decreases under the influence of an increased ferrite phase. As can be seen from FIG. 3, the amount of wear of valve seats decreases with an increase in the amount of the hard phase-forming powders added, while if the amount of the hard phase-forming powders exceeds 25%, the amount of wear of valves increases for reasons of an increased attack thereon due to an increased hard phase, leading to an increase in the amount of wear of valve seats. Thus, the total amount of wear of valves and valve seats is kept stable yet low if the amount of the hard phase-forming powders is between 10% and 25%. In view of strength and wear resistance, therefore, the amount of the hard phase-forming powders added is limited to the range of 3 to 25%.

Changes in hardness, radial crushing strength, and wear resistance when the chromium content of the hard phase-forming powders is varied are clarified by comparisons of the alloys 3–5, 23 according to the present invention, and 42–45 with comparative alloys 6–7.

Figure 4:
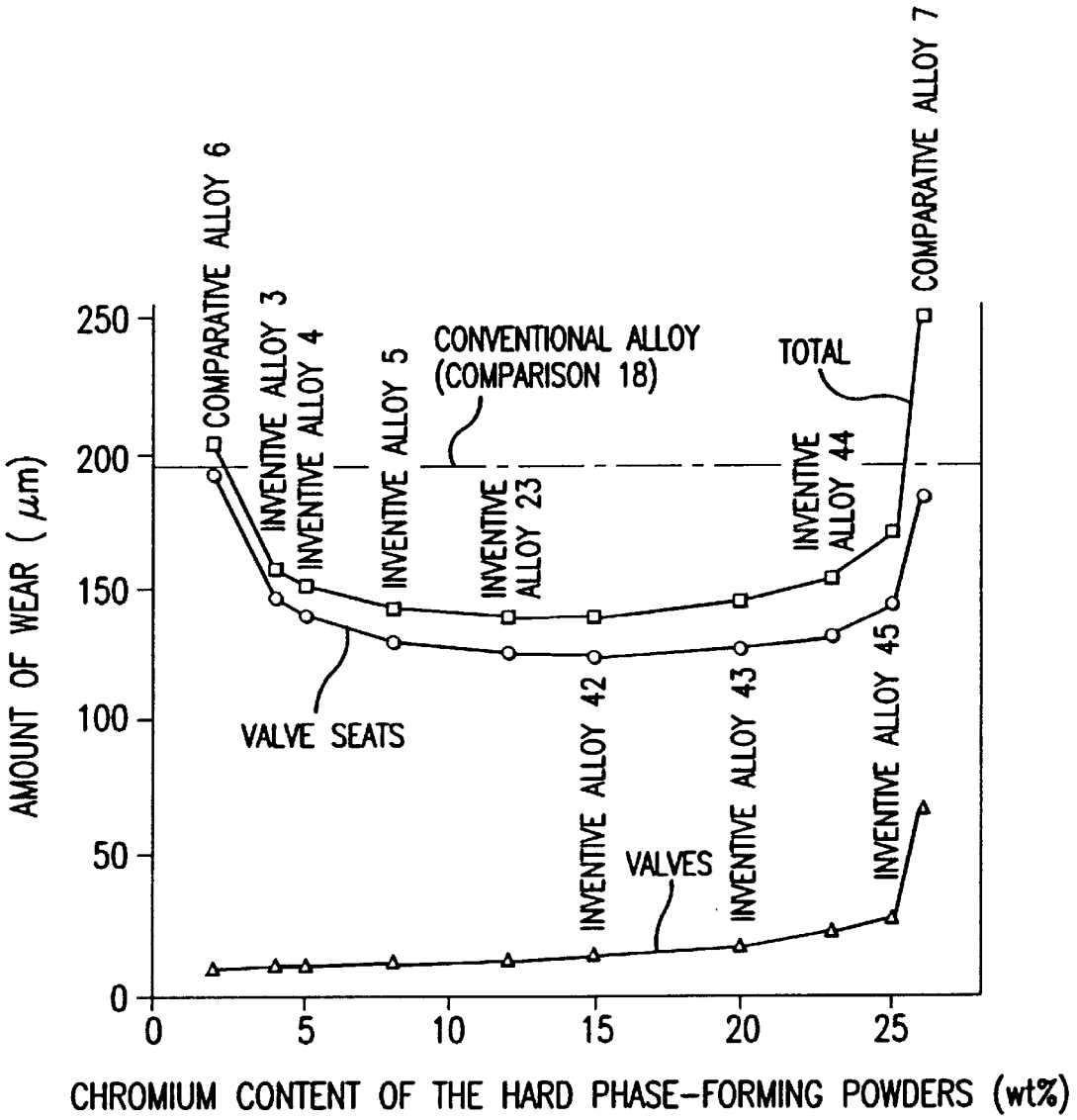
FIG. 4 is a graph showing the results of estimation of amount of wear when the chromium content of the hard phase-forming powders is varied.

As the chromium content of the hard phase-forming powders increases, the hardness and radial crushing strength increase for the reason of the effect of chromium on improvements in the hardenability of the matrix due to its diffusion. When chromium content exceeds 12%, however, such effect is offset by drops of the hardness and strength of the matrix due to an increase of the ferrite phase having a high chromium concentration, and so is stabilized. When chromium content increases further, it is found that both the hardness and radial crushing strength decrease partly because of a further increase in the amount of the ferrite phase, and partly because of a drop of the compressibility of the hard phase-forming powders due to an increase of chromium carbide. As shown in FIG. 4, it also found that if the chromium content of the hard phase-forming powders is less than 4% and exceeds 25%, there is then an amount of wear increase. At a chromium content less than 4%, no sufficient chromium carbide is formed in the hard phase, resulting in the wearing of valve seats. When a chromium content exceeds 25% on the other hand, there is an increase in the amount of the ferrite phase having a high chromium concentration (as confirmed by microphotographs). In addition, the amount of wear of valves increases for the reason of an increased attack thereon because the hard phase contains an increased amount of chromium carbide and powders peeling off the valves upon worn act on the valve seats as wearing particles, and so the valve seats wear away, too. This is the reason the chromium content of the hard phase-forming powders is limited to the range of 4 to 25%.

What happens when the molybdenum content of the hard phase-forming powders varies is clarified by comparisons of the alloys 6–9, 40 according to the present invention, and 41 with comparative alloy 8. It is here to be noted that the alloys 6–9, 40, and 41 according to the present invention relate to claims 1 and 2, with the alloy 6 of the present invention corresponding to claim 1 wherein the hard phase is described as being free from molybdenum.

Figure 5:
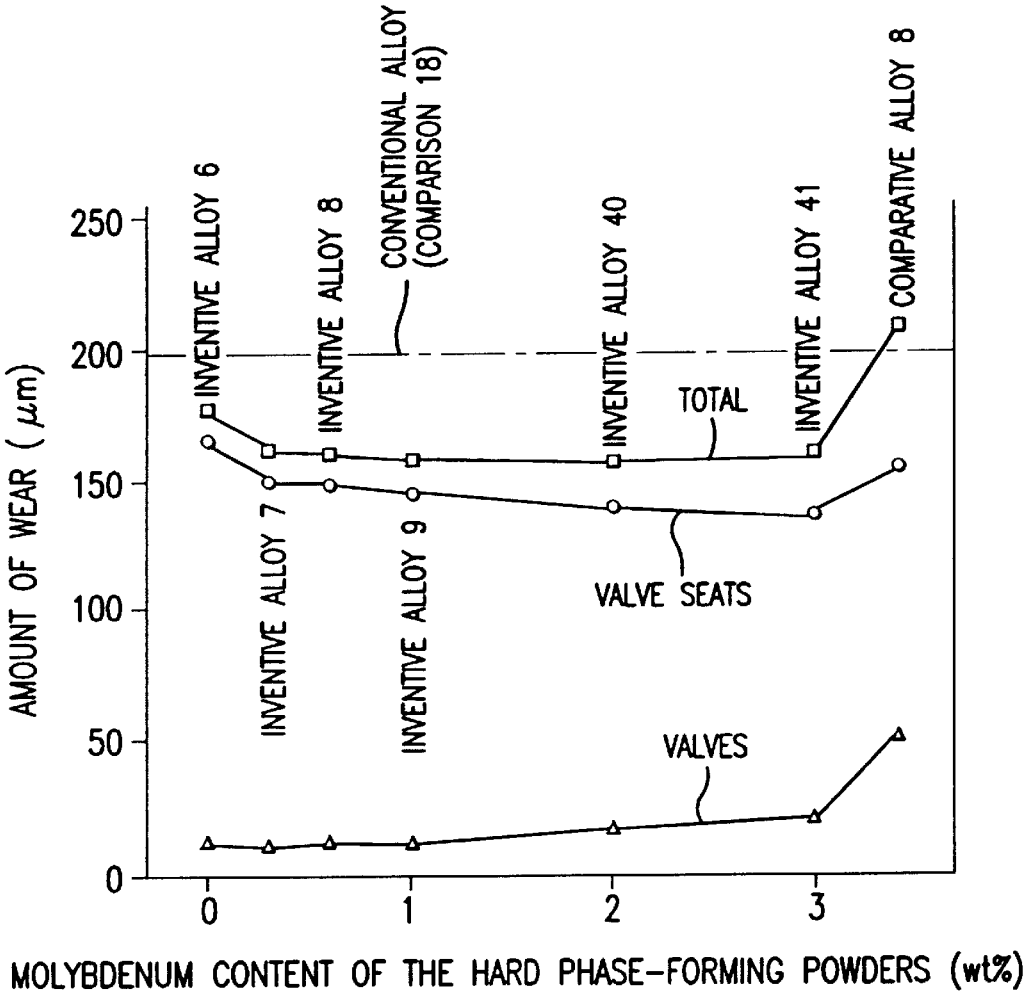
FIG. 5 is a graph showing the results of estimation of amount of wear when the molybdenum content of the hard phase-forming powders is varied.

It is found that as the molybdenum content of the hard phase-forming powders increases, hardness increases with an increase of molybdenum carbide, etc.; however, the incorporation of molybdenum in an amount exceeding 3% gives rise to a hardness drop for reasons of a density drop due to a compressibility drop occurring at the same time. It is also noted that strength decreases with an increase in the amount of molybdenum added as a result of an increase in the amount of the carbide in the hard phase increases. The amount of wear of the alloys according to the present invention is lower than that of the conventional alloy even when they are free from molybdenum as shown in FIG. 5. However, if the molybdenum is provided in the form of a solid solution to the hard phase-forming powders in an amount ranging from 0.3% to 3%, then the amount of wear of valve seats is kept lower yet more stable than that of a molybdenum-free valve seat, because the effect of the increase in the amount of molybdenum upon improvements in the wear resistance of valve seats is offset by the influence on an increased attack on valves. At more than 3%, however, the valve seats have excessively vigorous attack on valves, and so the valves wear away unavoidably and sharply. Consequently, the valve seats, too, decrease in terms of density because the powders become hard and decrease in terms of compressibility, ending up in a sharp amount of wear increase. Thus, it is found that even when the hard phase-forming powders are free from molybdenum, the alloys according to the present invention are more reduced in terms of amount of wear than the conventional alloy (comparative alloy 18), and so are improved in terms of quality performance. It is also found that by the incorporation of 0.3 to 3% of molybdenum in the hard phase-forming powders it is possible to improve wear resistance more effectively.

What happens when the vanadium content of the hard phase-forming powders varies is clarified by comparisons of the alloys 9, 17, 23, and 36–39 according to the present invention with comparative alloy 9. It is here to be noted that inventive alloys 9, 17, 23, and 36–39 correspond generally to claim 3.

As the vanadium content of the hard phase-forming powders increases, hardness increases due to an increase in the amount of fine vanadium carbide in the hard phase. When the amount of vanadium exceeds 2.2%, however, hardness decreases because the hard phase-forming powders become too hard, resulting in a compressibility drop. Strength, on the other hand, tends to decrease with an increase in the amount of vanadium. However, this strength drop is not quite large due to another effect on a strength increase, which is obtained by the precipitation of fine vanadium carbide in the hard phase (as confirmed by photomicrographs) whereby the coarsening of chromium carbide is prevented.

Figure 6:
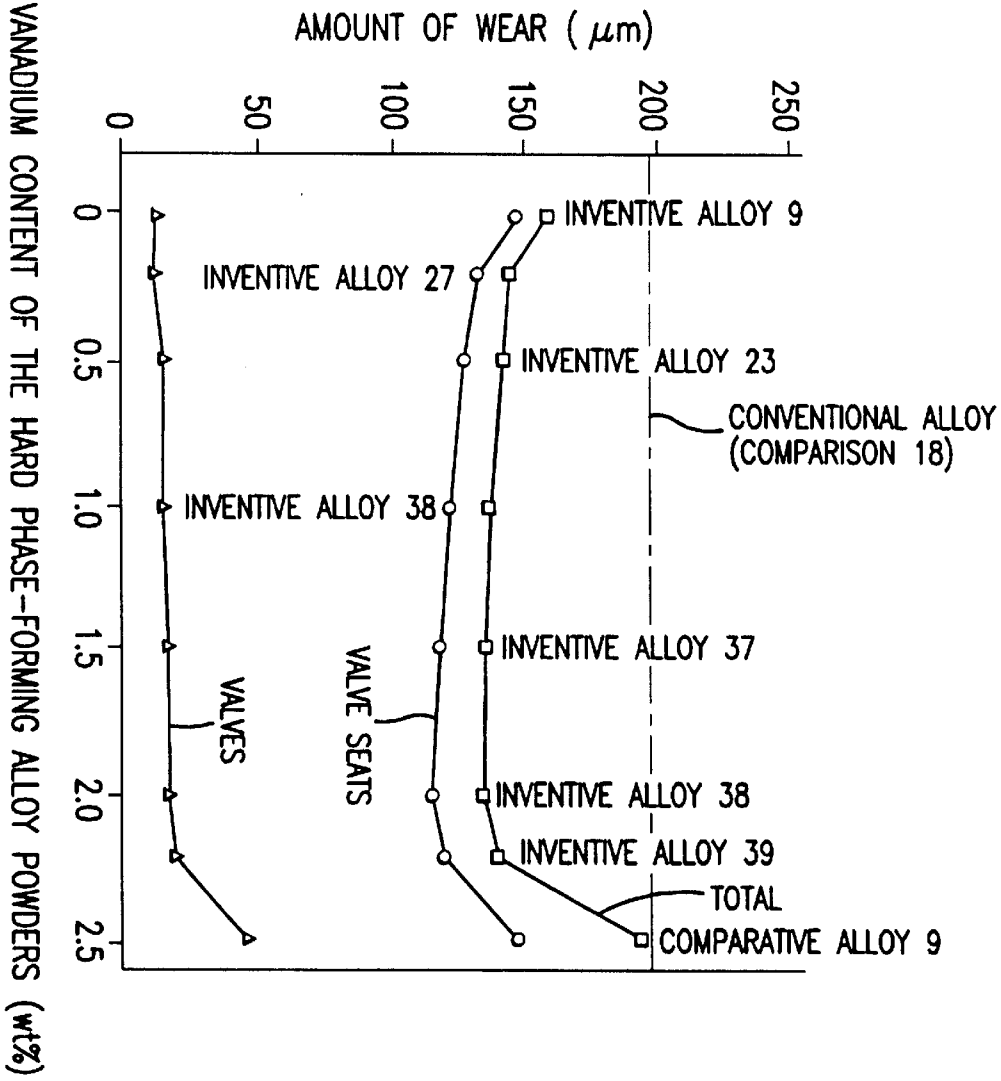
FIG. 6 is a graph showing the results of estimation of amount of wear when the vanadium content of the hard phase-forming alloys powders is varied.

Amount of wear can be further reduced by the incorporation of vanadium, as shown in FIG. 6, and is stably maintained as long as the amount of vanadium ranges from 0.2% to 2.2%. At more than 2.2%, however, amount of wear increases sharply for the reason of an increased vigour of attack on valves and a compressibility drop. It is thus understood that by the incorporation of 0.2 to 2.2% of vanadium in the hard phase-forming powders it is possible to achieve further improvements in wear resistance.

The influence of the tungsten content of the hard phase-forming powders is clarified by comparison of the alloys 9–16 according to the present invention with comparative alloy 10. It is here to noted that inventive alloys 9–16 correspond partly to claim 3.

As the amount of tungsten in the hard phase-forming powders increases, hardness increases with an increase in the amount of fine tungsten carbide in the hard phase. At more than 4%, however, hardness decreases because the hard phase-forming powders become hard, ending up in a compressibility drop. As in the case of vanadium, strength tends to decrease gently with an increase in the amount of tungsten.

Figure 7:
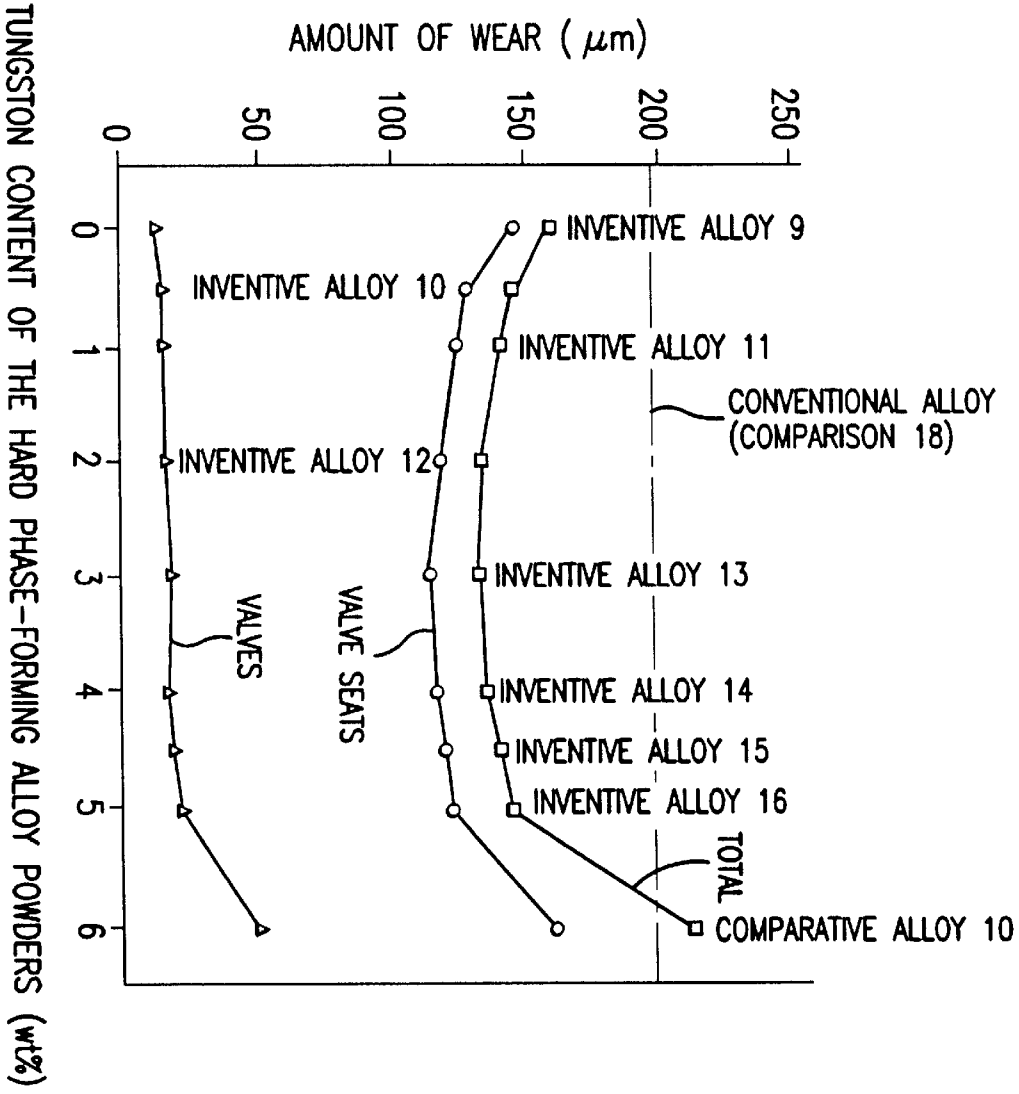
FIG. 7 is a graph showing the results of estimation of amount of wear when the tungsten content of the hard phase-forming alloys powders is varied.

Amount of wear can be further reduced by the incorporation of tungsten, as shown in FIG. 7, and is stably maintained as long as the amount of vanadium ranges from 0.5% to 5%. At more than 5%, however, amount of wear increases sharply for reasons of an increased attack on valves and a compressibility drop. It is thus understood that by the incorporation of 0.5 to 5% of tungsten in the hard phase-forming powders it is possible to achieve further improvements in wear resistance, as is the case with vanadium.

From the alloy 35 according to the present invention, it is found that when both vanadium and tungsten are concurrently provided to the molybdenum-containing hard phase-forming powders (see Tables 2, 3, and 8), strength decreases, but the valve receives an increased vigour of attack, and so increases slightly in terms of amount of wear, yet with a decrease in the amount of wear of the valve seat; that is, wear resistance is improved as a whole. It is here to be noted that the alloy 35 according to the present invention also corresponds partly to claim 3.

How hardness, radial crushing strength, and amount of wear changes when the carbon content of the hard phase-forming powders varies is clarified by comparisons of the alloys 18–20, 23, 33, and 34 according to the present invention with comparative alloys 11–12.

As the carbon content of the hard phase-forming powders increases, apparent hardness tends as a whole to increase whereas radial crushing strength is likely to drop with an increase in the amount of carbon. This explains a presumption that the increase in the amount of carbon in the hard phase-forming powders causes carbides to increase and so the powders to become hard, resulting in a drop of powder compressibility and, hence, drops of the density and strength of the samples.

Figure 8:
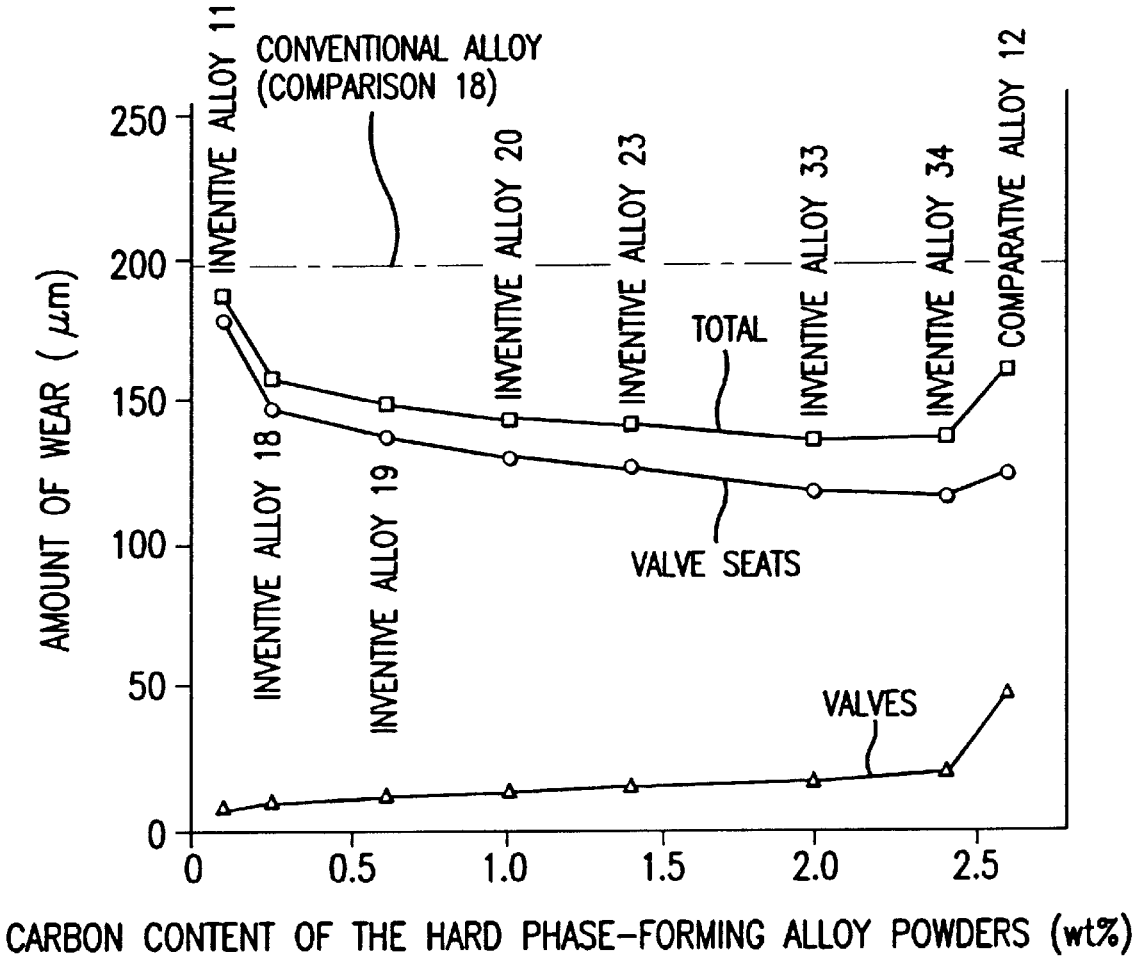
FIG. 8 is a graph showing the results of estimation of amount of wear when the carbon content of the hard phase-forming alloys powders is varied.

The amount of wear of valve seats, on the other hand, tends to decrease gently with an increase in the amount of carbon, provided that the amount of carbon ranges from 0.25 to 2.4%, as shown in FIG. 8. At more than 2.4%, however, there is a sharp increase in the amount of wear of valve seats.

Thus, when the carbon content of the hard phase-forming powders is less than 0.25%, the amount of carbides in the hard phase is insufficient to produce pin anchorage effect on prevention of the plastic flow of the matrix, resulting in an increased amount of wear. At more than 0.25%, however, the carbides are precipitated out in an amount sufficient to withstand the pin anchorage effect, resulting in improvements in wear resistance, and increases in the amount of carbon are useful for improvements in the wear resistance of valve seats. With a further increase in the amount of carbon in the hard phase-forming powders, however, valves receive an increased vigour of attack, and so the amount of wear of valves tends to increase although gently, and when the amount of carbon exceeds 2.4%, the amount of wear of valves proceeds sharply, simultaneously with the progress of the wearing of valve seats whose strength is reduced under the influences of powders peeling off the valves upon worn, resulting in a sharply increased amount of wear. It is thus that the amount of carbon in the hard phase-forming powders is limited to the range of 0.25 to 2.4%.

Figure 9:
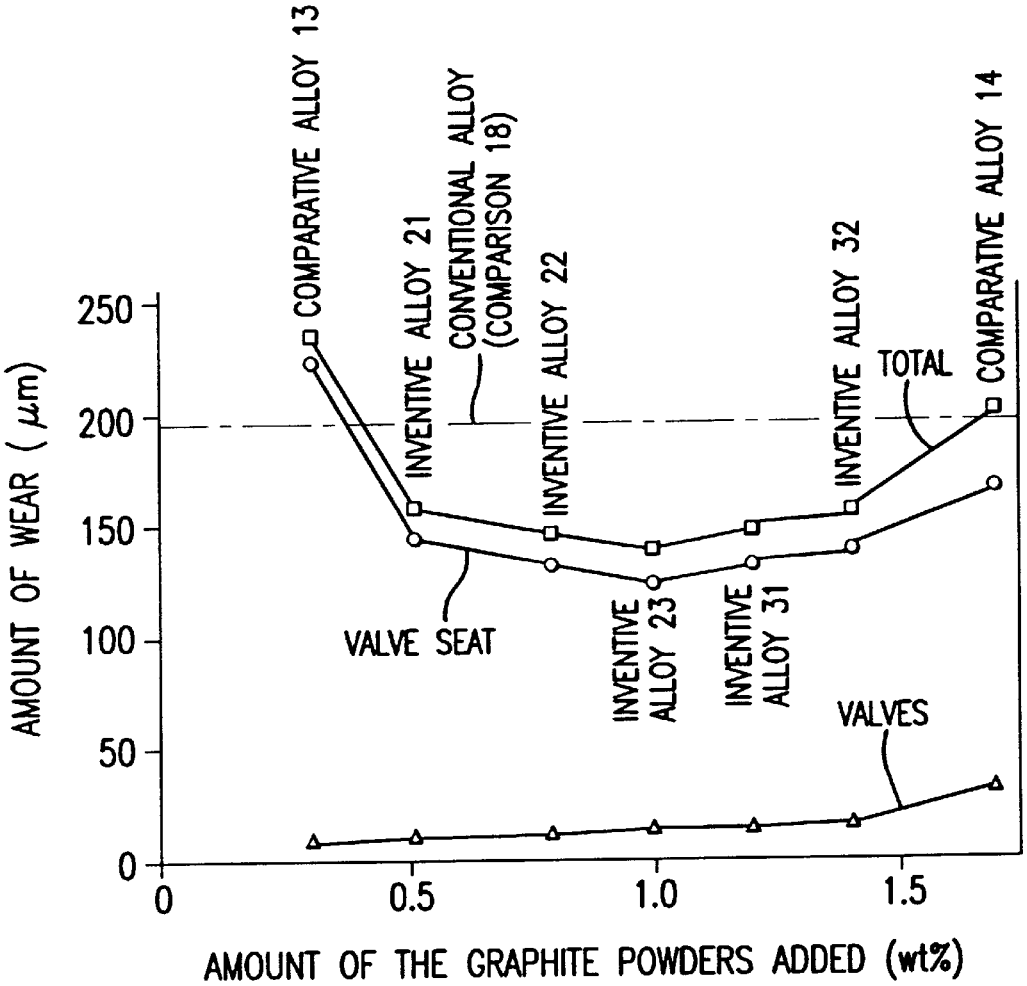
FIG. 9 is a graph showing the results of estimation of amount of wear when the amount of the graphite powders added is varied.

The relation between the added carbon (graphite) powders and amount of wear will now be explained by comparison of the alloys 21–23, 31, and 32 according to the present invention with comparative alloys 13–14, and with reference to FIG. 9.

It is found that when the amount of graphite powders added is less than 0.5% or more than 1.4%, there is an extremely increased amount of wear. This is because when the amount of graphite powders added is less than 0.5%, no sufficient chromium carbide is formed in the hard phase-forming powders, and when the amount of graphite powders exceed 1.4%, the amount of carbides becomes conversely too large (as confirmed by photo-micrographs), so that valves wear away due to an increased attack thereon while valve seats wear away, correspondingly. Thus, the amount of graphite powders added is limited to 0.5 to 1.4%.

How hardness, radial crushing strength, amount of wear, and machinability is affected depending on the amount of manganese sulfide powders added will now be clarified through comparisons of the alloys 23, 24, 28–30 according to the present invention with comparative alloy 15.

Figure 10:
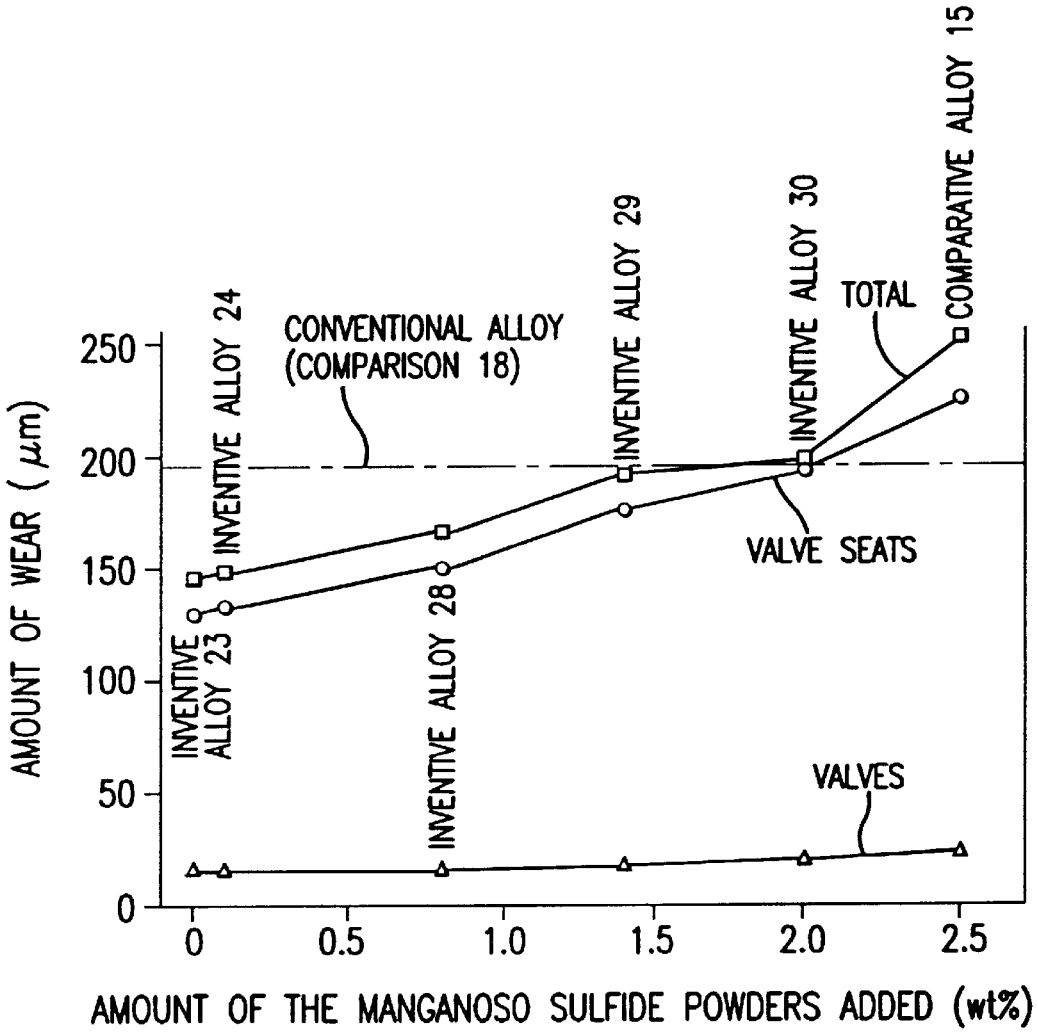
FIG. 10 is a graph showing the results of estimation of amount of wear when the amount of the manganese sulfide powders added is varied.

It is seen that as the amount of MnS powders added increases, both hardness and radial crushing strength decrease, with an increase in the amount of wear of valve seats, as shown in FIG. 10. This is believed to be because powder compressibility upon formed decreases with an increase in the amount of MnS powders added, and the progress of sintering is hindered by the manganese sulfide powders, resulting in a drop of mechanical properties. It is also found that there is an increase in the number of the holes to be drilled with an increase in the amount of MnS powders added, which in turn gives rise to improvements in machinability. Thus, the addition of MnS powders is effective for improvements in machinability. With hardness, strength, wear resistance, and machinability in mind, however, it is preferable to place the upper limit of MnS powders added at 2.0%.

How the machinability and wear resistance of the alloys 24–27 according to the present invention containing 0.1% of manganese sulfide powders change when they are infiltrated or impregnated with acrylic resin, lead, or copper is clarified.

It is found that the inventive alloys are improved in terms of machinability, and drillabillity by infiltration or impregnation with acrylic resin, lead, or copper, but undergo no drop of wear resistance. Thus, impregnation or infiltration is found to be effective for improvements in machinability (see Tables 3 and 8).

How wear resistance changes when all components are used in a mixed discrete powder form, and in the form of alloy powders wherein they are provided to the powders in the form of a perfect solid solution in place of the matrix-forming, partially diffused alloy powders according to the present invention is clarified through comparisons of inventive alloy 23 with comparative alloys 16, 17, and 18.

It is found that wear resistance drops irrespective of whether discrete powders or alloy powders are used in place of the matrix-forming, partially diffused alloy powders according to the present invention. It is also found that in view of wear resistance it is preferable to use discrete powders rather than alloy powders (see Tables 7 and 8). From the observation of photomicrographs, it is seen that in the case of the alloy powders, wear resistance is reduced due to no martensitic transformation of the matrix because the alloy elements are uniformly diffused throughout the matrix. In the case of discrete powders, on the other hand, it is believed that nickel is diffused throughout the matrix, so that a region having a relatively high nickel concentration can be improved in terms of hardenability and so subjected to martensitic transformation contributing to improvements in wear resistance. In the case of the discrete powders, however, it is found that the progress of sintering is delayed due to their poor diffusibility to cause pearlite of low strength to remain and the bond between the powders becomes weak; the achieved wear resistance is lower than would be possible with the matrix-forming, partially diffused alloy powders. Thus, it is understood that the partially diffused alloys are effective for matrix formation.

As can be appreciated from the foregoing explanation, the present invention successfully provides a wear-resistant sintered alloy which has high-enough wear resistance to enable it to be practically usable as a sintered alloy for valve seats in internal combustion engines, and is inexpensive as well due to no use of costly elements represented by cobalt, and its production method. Moreover, machinability is improved by dispersing manganese sulfide throughout the matrix of the inventive alloy, and/or alternatively impregnating or infiltrating pores therein with acrylic resin, lead or a lead alloy, or copper or a copper alloy.

What we claim is:

1. A wear-resistant sintered alloy having a general composition consisting essentially of, in weight ratio, 0.736 to 9.65% of nickel, 0.736 to 2.895% of copper, 0.294 to 0.965% of molybdenum, 0.12 to 6.25% of chromium, and 0.508 to 2.0% of carbon with the balance being iron, and inevitable impurities, and having a metallic structure in which there are dispersed (1) a martensite, (2) a bainite having a nucleus of sorbite and/or upper bainite and surrounding said nucleus, (3) an austenite having a high nickel concentration, and (4) a hard phase surrounding with a ferrite having a high chromium concentration and composed mainly of a chromium carbide.

2. A wear-resistant sintered alloy having a general composition consisting essentially of, in weight ratio, 0.736 to 9.65% of nickel, 0.736 to 2.895% of copper, 0.303 to 1.715% of molybdenum, 0.12 to 6.25% of chromium, and 0.508 to 2.0% of carbon with the balance being iron, and inevitable impurities, and having a metallic structure in which there are dispersed (1) a martensite, (2) a bainite having a nucleus of sorbite and/or upper bainite and surrounding said nucleus, (3) an austenite having a high nickel concentration, and (4) a hard phase surrounding with a ferrite having a high chromium concentration and composed mainly of a chromium carbide.

3. A wear-resistant sintered alloy having a general composition consisting essentially of, in weight ratio, 0.736 to 9.65% of nickel, 0.736 to 2.895% of copper, 0.303 to 1.715% of molybdenum, 0.12 to 6.25% of chromium, 0.508 to 2.0% of carbon, and 0.006 to 0.55% of vanadium and/or 0.03 to 1.25% of tungsten with the balance being iron, and inevitable impurities, and having a metallic structure in which there are dispersed (1) a martensite, (2) a bainite having a nucleus of sorbite and/or upper bainite and surrounding said nucleus, (3) an austenite having a high nickel concentration, and (4) a hard phase surrounding with a ferrite having a high chromium concentration and composed mainly of a chromium carbide.

4. The wear-resistant sintered alloy according to claim 1, in which 2.0% or less by weight of manganese sulfide is homogeneously dispersed.

5. The wear-resistant sintered alloy according to claim 1, wherein any one of an acrylic resin, lead or a lead alloy, and copper or a copper alloy is dispersed into pores in said wear-resistant sintered alloy.

6. A method of producing the wear-resistant sintered alloy according to claim 1, comprising forming a powder mixture of (A) 0.5 to 1.4% by weight of a graphite powder and (B) 3 to 25% by weight of a hard phase-forming powder having a composition consisting essentially of, in weight ratio, 4.0 to 25% of chromium, and 0.25 to 2.4% of carbon with the balance being iron, and inevitable impurities with (C) a matrix-forming, partially diffused alloy powder having a composition consisting essentially of, in weight ratio, 1 to 10% of nickel, 1 to 3% of copper, and 0.4 to 1.0% of molybdenum with the balance being iron, and inevitable impurities, compacting said powder mixture into a formed body, and sintering said formed body to thereby obtain said wear-resistant sintered alloy.

7. A method of producing the sintered alloy according to claim 2, comprising forming a powder mixture of (A) 0.5 to 1.4% by weight of a graphite powder and (B) 3 to 25% by weight of a hard phase-forming powder having a composition consisting essentially of, in weight ratio, 4.0 to 25% of chromium, 0.3 to 3.0% of molybdenum, and 0.25 to 2.4% of carbon with the balance being iron, and inevitable impurities with (C) a matrix-forming, partially diffused alloy powder having a composition consisting essentially of, in weight ratio, 1 to 10% of nickel, 1 to 3% of copper, and 0.4 to 1.0% of molybdenum with the balance iron, and inevitable impurities, compacting said powder mixture into a formed body, and sintering said formed body to thereby obtain said wear-resistant sintered alloy.

8. A method of producing the wear-resistant sintered alloy according to claim 3, comprising forming a powder mixture of (A) 0.5 to 1.4% by weight of a graphite powder and (B) 3 to 25% by weight of a hard phase-forming powder having a composition consisting essentially of, in weight ratio, 7.5 to 25% of chromium, 0.3 to 3.0% of molybdenum, 0.25 to 2.4% of carbon, and 0.2 to 2.2% of vanadium and/or 1.0 to 5.0% of tungsten with the balance being iron, and inevitable impurities with (C) a matrix-forming, partially diffused alloy powder having a composition consisting essentially of, in weight ratio, 1 to 10% of nickel, 1 to 3% of copper and 0.4 to 1.0% of molybdenum with the balance being iron, and inevitable impurities, compacting said powder mixture into a formed body, and sintering said formed body to thereby obtain said wear-resistant sintered alloy.

9. A method of producing the wear-resistant sintered alloy according to any one of claims 6–8, wherein 0.1 to 2.0% by weight of a manganese sulfide powder is further mixed with the powder mixture to thereby homogeneously disperse 2% or less by weight of manganese sulfide in said wear-resistant sintered alloy.

10. A method of producing a wear-resistant sintered alloy according to any one of claims 6–8, further comprising impregnating or infiltrating any one of an acrylic resin, lead or a lead alloy, and copper or a copper alloy into pores in the sintered body obtained by compacting and sintering the powder mixture.

11. The wear-resistant sintered alloy according to claim 2, in which 2.0% or less by weight of manganese sulfide is homogeneously dispersed.

12. The wear-resistant sintered alloy according to claim 3, in which 2.0% or less by weight of manganese sulfide is homogeneously dispersed.

13. The wear-resistant sintered alloy according to claim 2, wherein any one of an acrylic resin, lead or a lead alloy, and copper or a copper alloy is dispersed into pores in said wear-resistant sintered alloy.

14. The wear-resistant sintered alloy according to claim 3, wherein any one of an acrylic resin, lead or a lead alloy, and copper or a copper alloy is dispersed into pores in said wear-resistant sintered alloy.

15. The wear-resistant sintered alloy according to claim 4, wherein any one of an acrylic resin, lead or a lead alloy, and copper or a copper alloy is dispersed into pores in said wear-resistant sintered alloy.

16. A method of producing a wear-resistant sintered alloy according to claim 9, further comprising impregnating or infiltrating any one of an acrylic resin, lead or a lead alloy, and copper or a copper alloy into pores in the sintered body obtained by forming and sintering the powder mixture.

17. The wear-resistant sintered alloy according to claim 11, wherein any one of an acrylic resin, lead or a lead alloy, and copper or a copper alloy is dispersed into pores in said wear-resistant sintered alloy.

18. The wear-resistant sintered alloy according to claim 12, wherein any one of an acrylic resin, lead or a lead alloy, and copper or a copper alloy is dispersed into pores in said wear-resistant sintered alloy.

* * * * *